US012297608B2

(12) United States Patent
Reardon et al.

(10) Patent No.: US 12,297,608 B2
(45) **Date of Patent: *May 13, 2025**

(54) SELECTIVELY FRICTIONALLY ENGAGED HOLE COVER

(71) Applicant: Clover Equipment, LLC, Anaheim, CA (US)

(72) Inventors: Mike Reardon, Yorba Linda, CA (US); Kevin Reardon, Anaheim Hills, CA (US)

(73) Assignee: Clover Equipment, LLC, Anaheim, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/917,488

(22) Filed: Oct. 16, 2024

(65) Prior Publication Data

US 2025/0122676 A1 Apr. 17, 2025

Related U.S. Application Data

(63) Continuation-in-part of application No. 18/487,680, filed on Oct. 16, 2023.

(51) Int. Cl.
*E01C 9/08* (2006.01)

(52) U.S. Cl.
CPC ..... *E01C 9/083* (2013.01)

(58) Field of Classification Search
CPC ..... E01C 9/083
USPC ..... 404/25; 52/20, 21, 19
See application file for complete search history.

(56) References Cited

U.S. PATENT DOCUMENTS 1,363,804 A * 12/1920 Mohn ..... B65D 39/12 215/360
2,488,796 A * 11/1949 Baier ..... B63B 19/14 114/201 R
2,729,353 A * 1/1956 Moeller ..... B65D 39/12 114/183 R
2,891,694 A * 6/1959 Ackley ..... B65D 39/12 220/238
3,294,000 A * 12/1966 Pelsue ..... E02D 29/12 404/26

(Continued)

FOREIGN PATENT DOCUMENTS

GB 190110614 A * 5/1902 ..... E06B 5/14

*Primary Examiner* — Raymond W Addie
(74) *Attorney, Agent, or Firm* — UltimatEdge IP Law Group, P.C.; Dean G. Stathakis

(57) ABSTRACT

A selectively frictionally engaged hole cover for a bore hole cored from a paved surface that includes a cover plate configured to cover the bore hole and support vehicular traffic. An engagement mechanism is attached to the cover plate and extends down into the bore hole. The engagement mechanism is configured to be actuated by a user torque input that causes an engagement plate selectively shiftable relative to the cover plate to thereby shift an engagement member along a engagement member stop and thus radially outwardly or inwardly, causing the engagement mechanism to selectively engage or disengage the wall of the bore hole. When the engagement member is in frictional contact with the hole, unintentional extraction of the engagement mechanism is prevented. The selectively frictionally engaged hole cover effectively provides a temporary cover for a bore hole in a road, parking lot, or other paved surface.

20 Claims, 14 Drawing Sheets

(56) References Cited

U.S. PATENT DOCUMENTS

| | | | | | |
|---|---|---|---|---|---|
| 4,020,778 | A * | 5/1977 | Sutton | B63B 43/32 | 292/6 |
| 4,279,356 | A * | 7/1981 | Amorese | F16J 13/20 | 220/314 |
| 4,706,718 | A * | 11/1987 | Milo | B65D 90/105 | 404/26 |
| 4,763,449 | A * | 8/1988 | Vigneron | E02D 29/149 | 220/301 |
| 5,275,501 | A * | 1/1994 | Amorese | F16J 13/08 | 404/25 |
| 6,682,257 | B1 * | 1/2004 | Zappe | E02D 29/149 | 404/25 |
| 7,153,057 | B1 * | 12/2006 | Lucas | E02D 29/14 | 404/25 |
| 7,607,858 | B1 * | 10/2009 | Mosholder | E02D 29/1427 | 404/25 |
| 10,344,447 | B2 * | 7/2019 | Sauve | E02D 29/1409 | |
| 12,145,286 | B2 * | 11/2024 | Griffin | B26B 21/4012 | |

* cited by examiner

SELECTIVELY FRICTIONALLY ENGAGED HOLE COVER

This application is a continuation-in-part that claims the benefit of priority and is entitled to the filing date pursuant to 35 U.S.C. § 120 of U.S. Non-Provisional patent application Ser. No. 18/487,680, filed Oct. 16, 2023, the content of which is hereby incorporated by reference in its entirety.

BACKGROUND

The subject of this patent application relates generally to temporary covers for covering holes in paved surfaces so that vehicular traffic can safely travel thereover.

By way of background, when locating and verifying subsurface utilities (e.g., water, power, gas, telephone, sewer, cable, oil lines, reclaimed water, and so on) it is common practice to core approximately a 6-inch to 12-inch diameter hole though the asphalt or concrete. Once the asphalt or concrete core is removed, the field crew will then hydro excavate down to the utility to positively identify the line. Thereafter, the core is left open with the utility exposed to allow for survey crews, inspection crews, digging crews, drilling crews, etc. to visually identify the line they are working with and/or around.

During non-working hours, a cover (often called a "graduation cap" due to its appearance) is placed over the core hole to permit safe passage of pedestrians and vehicular traffic. Many current graduation caps are made from heavy-duty steel materials, with a large diameter steel pipe having a steel plate welded to the top end. The pipe portion is dropped into the bore hole, with the plate resting atop the rim of the hole, with only the weight of the graduation cap holding it within the hole. As high-speed vehicles drive over the plate, the graduation caps have issues with becoming dislodged from the core and ejected onto the street. This causes great damage to vehicles due to impact with the dislodged graduation cap and/or the open bore hole itself. What is needed is a bore hole cover that can withstand the stresses of vehicular traffic without becoming dislodged.

Aspects of the present invention fulfill these needs and provide further related advantages as described in the following summary.

SUMMARY

Aspects of the present invention teach certain benefits in construction and use which give rise to the exemplary advantages described below.

The present specification discloses a selectively frictionally engaged hole cover generally comprising a cover plate coupled to an engagement mechanism. The cover plate includes a top surface and a bottom surface opposite the top surface. The engagement mechanism includes an engagement plate selectively shiftable relative to the cover plate and configured to thereby shift an engagement member along a engagement member stop and thus radially outwardly or inwardly. The engagement mechanism is coupled with the cover plate and extends from the bottom surface of the cover plate. During an insertion procedure, the engagement mechanism is configured to be positioned within the bore hole and supported at least initially therein by the cover plate that is configured to rest upon the paved surface and substantially cover the bore hole. And, during an engagement procedure, the engagement mechanism is configured to be actuated to cause a first movement of the engagement plate so as to shift the engagement member along the engagement member stop radially outwardly to move the engagement member into frictional contact with the bore hole and to substantially prevent extraction of the engagement mechanism from the bore hole and substantially prevent lifting of the cover plate due to forces exerted by vehicular traffic thereupon.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

Figure 1:
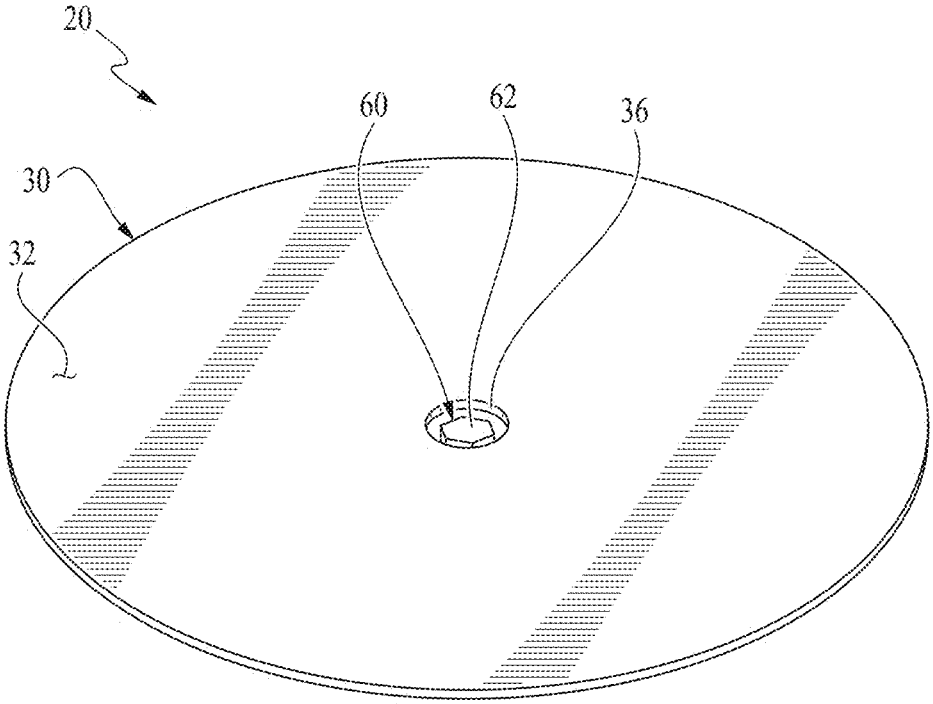
FIG. 1 is an assembled top perspective view of an exemplary embodiment of a selectively frictionally engaged hole cover disclosed herein.

Listing of Reference Numbers Associated with Drawings

| Ref. No. | Element |
|---|---|
| 20 | Selectively frictionally engaged hole cover |
| 30 | Cover plate |
| 32 | Top surface |
| 34 | Bottom surface |
| 36 | Access hole |
| 38 | Cover plate skirt |
| 39 | Slots |
| 40 | Engagement mechanism |
| 50 | Engagement support bracket |
| 52 | Bracket sidewall |
| 54 | Support plate |
| 56 | Support plate hole |
| 58 | Bracing rib |
| 60 | Engagement screw |
| 62 | Head |
| 64 | Shank |
| 66 | Threaded portion |
| 70 | Engagement member stop |
| 80 | Engagement plate |
| 82 | Top surface |
| 84 | Bottom surface |
| 86 | Through-hole |
| 87 | Boss |
| 88 | Perimeter lip |
| 89 | Through hole |
| 90 | Engagement member |
| 100 | Stand-off |
| 106 | Through-hole |
| 110 | Retainer plate |
| 112 | Top surface |
| 114 | Bottom surface |
| 116 | Retainer plate hole |
| 118 | Retainer plate skirt |
| 120 | Bracket housing |
| 122 | Bottom portion |
| 124 | Angled portion |
| 126 | Skirt portion |
| 128 | Through-hole |
| 130 | Reinforcement plate |
| 132 | Top surface |
| 134 | Bottom surface |
| 136 | Nut seat |
| 140 | Nut |
| 142 | Threaded through-hole |
| H | Bore hole |
| W | Bore hole wall |
| P | Paved surface |
| C | Course |
| B | Base |
| S | Sub-grade |
| U | Utility |

DETAILED DESCRIPTION

The present specification discloses a selectively frictionally engaged hole cover for a bore hole cored from a paved surface that includes a cover plate and an engagement mechanism. A cover plate disclosed herein is configured to cover the bore hole and support vehicular traffic. An engagement mechanism disclosed herein is operably attached to the cover plate and extends down into the bore hole and comprises an engagement support bracket, an engagement screw, an engagement plate, and an engagement member. The engagement mechanism is configured to be actuated by a user torque input that is transmitted through the engagement screw threadably connected with the engagement plate to selectively raise or lower the engagement plate and thereby cause the engagement member to selectively engage or disengage a wall of the bore hole as the engagement member moves up and against or down and away from an engagement member stop and so selectively shifts the engagement member radially outwardly or inwardly. When the engagement mechanism is engaged with the bore wall via the engagement member as urged radially outwardly under the influence of the engagement plate upon rotation of the engagement screw by the user, the selectively frictionally engaged hole cover is prevented from being unintentionally extracted from the bore hole. The selectively frictionally engaged hole cover effectively provides a temporary cover for a bore hole in a road, parking lot, or other paved surface that supports vehicular traffic, that prevents extraction due to vibrations of passing traffic, and that thus prevents damage to cars and their occupants.

The present selectively frictionally engaged hole cover 20 is illustrated in FIGS. 1-17 and generally includes a cover plate 30 with an engagement mechanism 40. Cover plate 30 has a central access hole 36 that communicates between a top surface 32 and a bottom surface 34 of cover plate 30. Cover plate 30 has a diameter that is greater than that of engagement mechanism as well as a bore hole H itself so as to span and seat over bore hole H even as engagement mechanism 40 is seated within bore hole H. Engagement mechanism 40 is coupled to and extends from bottom surface 34 of cover plate 30 and substantially conforms to or is slightly clear of or inset from the respective bore hole wall W. Engagement mechanism 40 generally includes an engagement support bracket 50, an engagement screw 60, an engagement plate 80, and an engagement member 90. Engagement mechanism 40 can have a variety of configurations that convert a user torque input into radial or lateral expansion to grip or frictionally engage a wall W of a bore hole H (as exemplified in FIGS. 5, 10, and 17). Generally, engagement plate 80 is operably spaced from and configured to shift up and down relative to bottom surface 34 of cover plate 30 so as to thereby cause an engagement member 90 in contact with engagement plate 80 to selectively move up and against or down and away along an engagement member stop 70 and thus shift outwardly or inwardly radially or laterally. An engagement screw 60 operably installed between cover plate 30 and engagement plate 80 selectively raises or lowers engagement plate 80 as rotation or torque is applied to the engagement screw 60, which is, in one or more embodiments, accessed by an appropriate tool (e.g., a socket wrench, a T-handle wrench, a speed or crack handle wrench, an impact wrench, and numerous other hand or power tools that can be used to impart a torque on engagement screw 60) through access hole 36. Thus, upon actuation (applied through a user torque input), engagement screw 60 rotates and amplifies the magnitude of the torque and/or converts the torque to generally radial or lateral movement of engagement member 90 (e.g., movement toward/from the bore hole wall W).

While a particular configuration of the exemplary selectively frictionally engaged hole cover 20 and thus of cover plate 30 and engagement mechanism 40 is shown and described, it will be appreciated by those skilled in the art that the invention is not so limited and other configurations and related assembly and operability arrangements are possible according to aspects of the present invention without departing from its spirit and scope. By way of illustration and not limitation, the sizes and shapes of the various components can vary, and particularly engagement member 90, while shown and described as an annular gasket or o-ring, may take other forms; or engagement member 90 may be sized and configured to itself not frictionally engage bore hole wall W but instead to support other operably coupled engagement members configured, for example, as curved tabs or pads or other surfaces that in cooperation with the gasket-like portion of engagement member 90 are selectively forced radially or laterally outwardly and into frictional contact or engagement with bore hole wall W as they are lifted along engagement member stop 70 of the engagement mechanism 40 by upward movement of engagement plate 80, which tabs or pads or the like may be configured to grip the wall and include a radius similar to bore hole H radius. Regardless, those skilled in the art will appreciate that the selectively frictionally engaged hole cover 20 according to aspects of the present invention is a relatively simple mechanical arrangement with fewer mechanical or moving components, thereby reducing or eliminating potential failure points, and also a relatively more compact design for better storage efficiency. Of course, hole cover apparatus 20 can be easily scaled for use with larger or smaller bore hole H sizes (e.g., 6-inch or 12-inch diameter hole).

Figure 2:
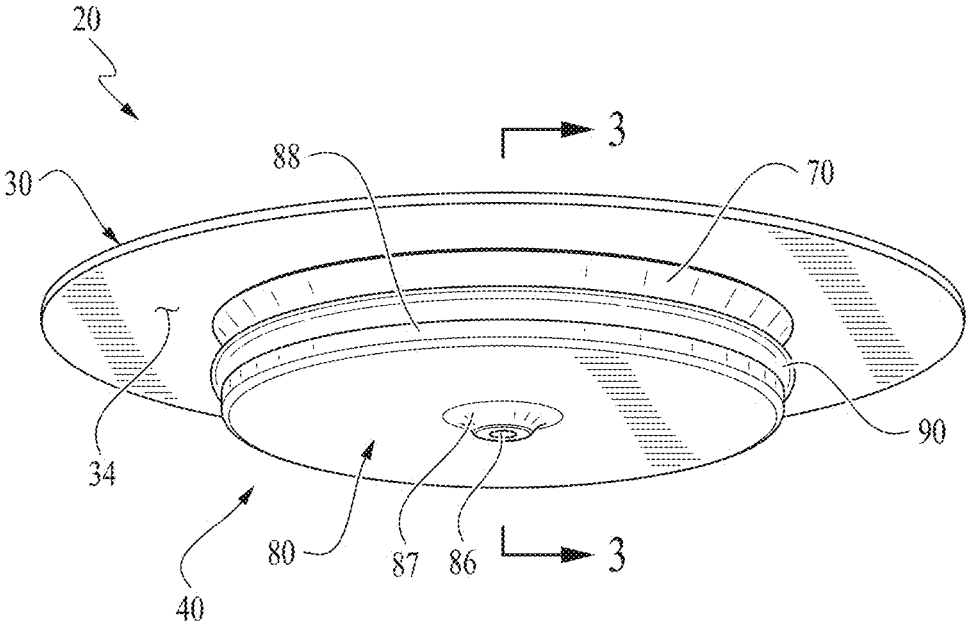
FIG. 2 is an assembled bottom perspective view of the selectively frictionally engaged hole cover of FIG. 1.
Figure 3:
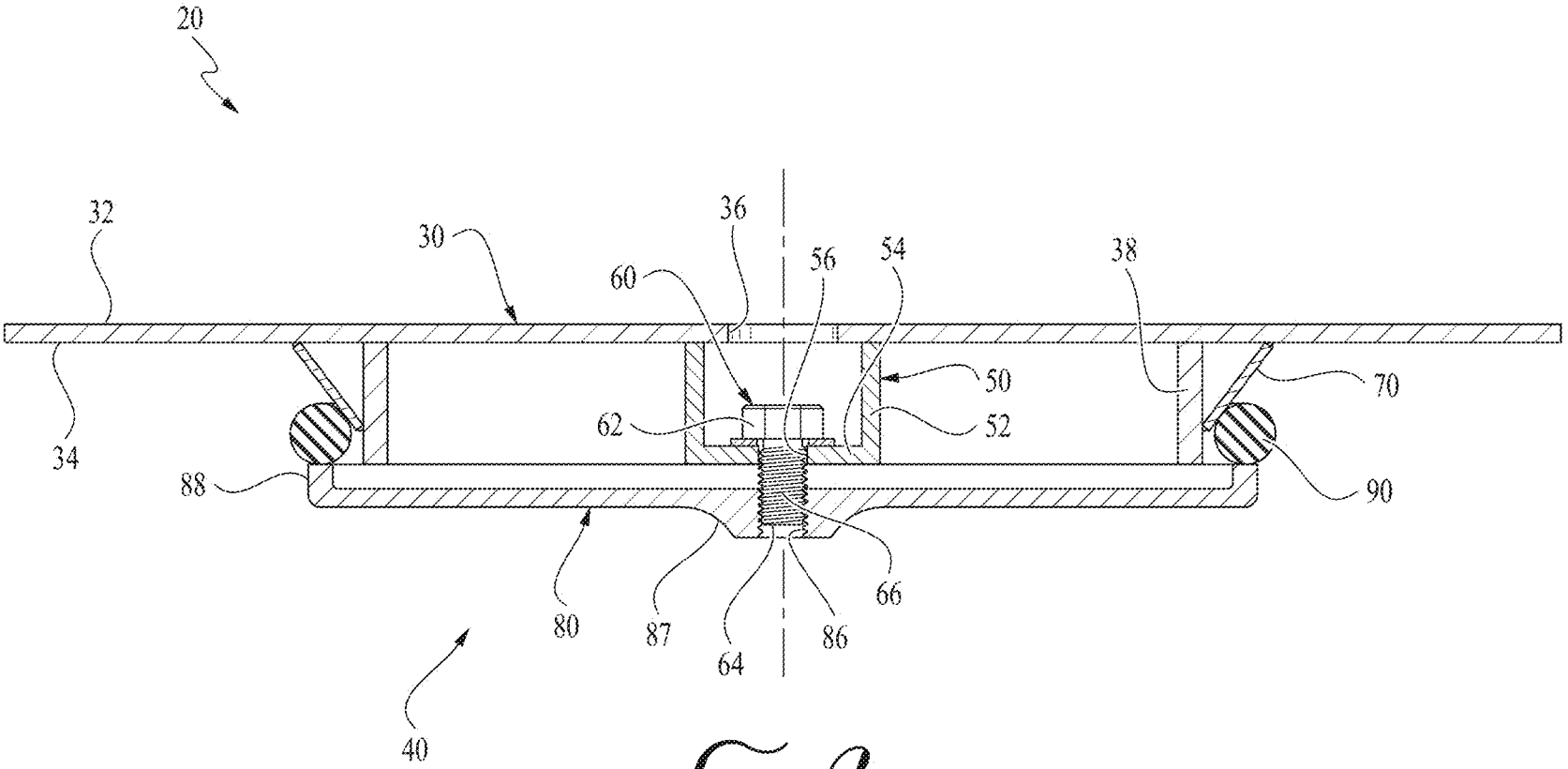
FIG. 3 is an enlarged side cross-sectional view of the selectively frictionally engaged hole cover of FIG. 1 taken from line 3-3 of FIG. 2.

Referring now to FIGS. 1-3, an example embodiment of the present selectively frictionally engaged hole cover 20 is illustrated and generally includes a cover plate 30 with an engagement mechanism 40 coupled thereto and extending from bottom surface 34 of cover plate 30.

Cover plate 30 is a circular plate having a diameter that is greater than engagement mechanism 40 and is sized larger than bore hole H so as to span and seat over bore hole H even as engagement mechanism 40 is seated within bore hole H. Cover plate 30 has a central access hole 36 that communicates between a top surface 32 and a bottom surface 34 of cover plate 30. As best seen in FIG. 3, cover plate 30 further compress a cover plate skirt 38 including engagement member stop 70. Positioned radially outwardly of central engagement support bracket 50, cover plate skirt 38 extends downwardly and distally from bottom surface 34 of cover plate 30 (i.e., facing into the bore hole H when installed) which may again be integral with or connected to cover plate 30 as by welding or otherwise. Engagement member stop 70 spans between an outer surface of cover plate skirt 38 and bottom surface 34 to form an annular angled or sloped wall. Engagement member stop 70 can be integral with or connected to bottom surface 34 of cover plate 30 and cover plate skirt 38 as by welding or otherwise.

With continued reference to the illustrated example embodiment of FIGS. 1-3, engagement mechanism 40 is coupled to and extends from bottom surface 34 of cover plate 30 and comprises engagement support bracket 50, engagement screw 60, engagement plate 80, and engagement member 90.

Engagement support bracket 50 extends from bottom surface 34 (i.e., facing into the bore hole H when installed) substantially centered about access hole 36, the engagement support bracket 50 having an annular bracket sidewall 52 terminating in a support plate 54 spaced from bottom surface 34 of cover plate 30 and having a support plate hole 56 formed therein offset from and substantially aligned with access hole 36 of cover plate 30. Bracket sidewall 52 may be attached to bottom surface 34 of cover plate 30 at its top edge, for example, as by welding the top edge to bottom surface 34, and similarly support plate 54 may be integral with or connected to bracket sidewall 52 by welding or other appropriate means now known or later developed.

As best seen in FIG. 3, engagement screw 60 has a head 62 configured to pass through access hole 36 and seat on support plate 54 and a shank 64 configured to pass through support plate hole 56 with a distal threaded portion 66 configured to threadably engage a threaded hole 86 formed centrally in the offset engagement plate 80. Rotation of engagement screw 60 as by operably engaging head 62 via access hole 36 with an appropriate tool thereby selectively raises or lowers engagement plate 80 relative to cover plate 30 as rotation or torque is applied to engagement screw 60. In one or more embodiments, an appropriate tool includes, without limitation, a socket wrench, a T-handle wrench, a speed or crack handle wrench, an impact wrench, and numerous other hand or power tools that can be used to impart a torque. Thus, upon actuation (applied through a user torque input), engagement screw 60 rotates and amplifies the magnitude of the torque and/or converts the torque to generally radial or lateral movement of engagement member 90 (e.g., movement toward/from bore hole wall W).

Engagement plate 80 is a circular plate having a diameter and includes centrally located threaded hole 86 that communicates between a top surface 82 and a bottom surface 84 of engagement plate 80 and a perimeter lip 88 extending substantially perpendicular from top surface 82 and surrounding an outer perimeter edge of engagement plate 80. A raised boss 87 may be formed about threaded hole 86 simply to provide for more material thickness where threaded hole 86 is formed in engagement plate 80. Perimeter lip 88 and may be integral with or connected to engagement plate 80 as by welding, adhesives or with the use fasteners, such as, e.g., screws or rivets. Perimeter lip 88 supports engagement member 90 vertically or from beneath and selectively shift engagement member 90 upwardly along engagement member stop 70 and thus radially outwardly as engagement plate 80 is shifted upwardly due to rotation of engagement screw 60. Engagement plate 80 and thus the annular position of perimeter lip 88 is substantially vertically aligned with the center of engagement member 90 and the midline of engagement member stop 70, which outer annular alignment or general profile of engagement mechanism 40 substantially conforms to or is slightly clear of or inset from the respective bore hole wall W. In addition, the outer diameters of cover plate skirt 38 and engagement member 90 are approximately equal, As such, the outer annular alignment or general profile of engagement mechanism 40 substantially conforms to or is slightly smaller than or insets from the respective bore hole wall W.

Engagement member 90 may be formed as an annular gasket or o-ring having a nominal or "at rest" diameter approximately the same as or slightly larger than that of cover plate skirt 38 and having a degree of elasticity so as to stretch and expand as engagement member 90 transitions along engagement member stop 70 that effectively provides an expanding or increasing diameter on which engagement member 90 seats. Engagement member 90 has a diameter configured to align with the midline of engagement member stop 70.

Figure 4:
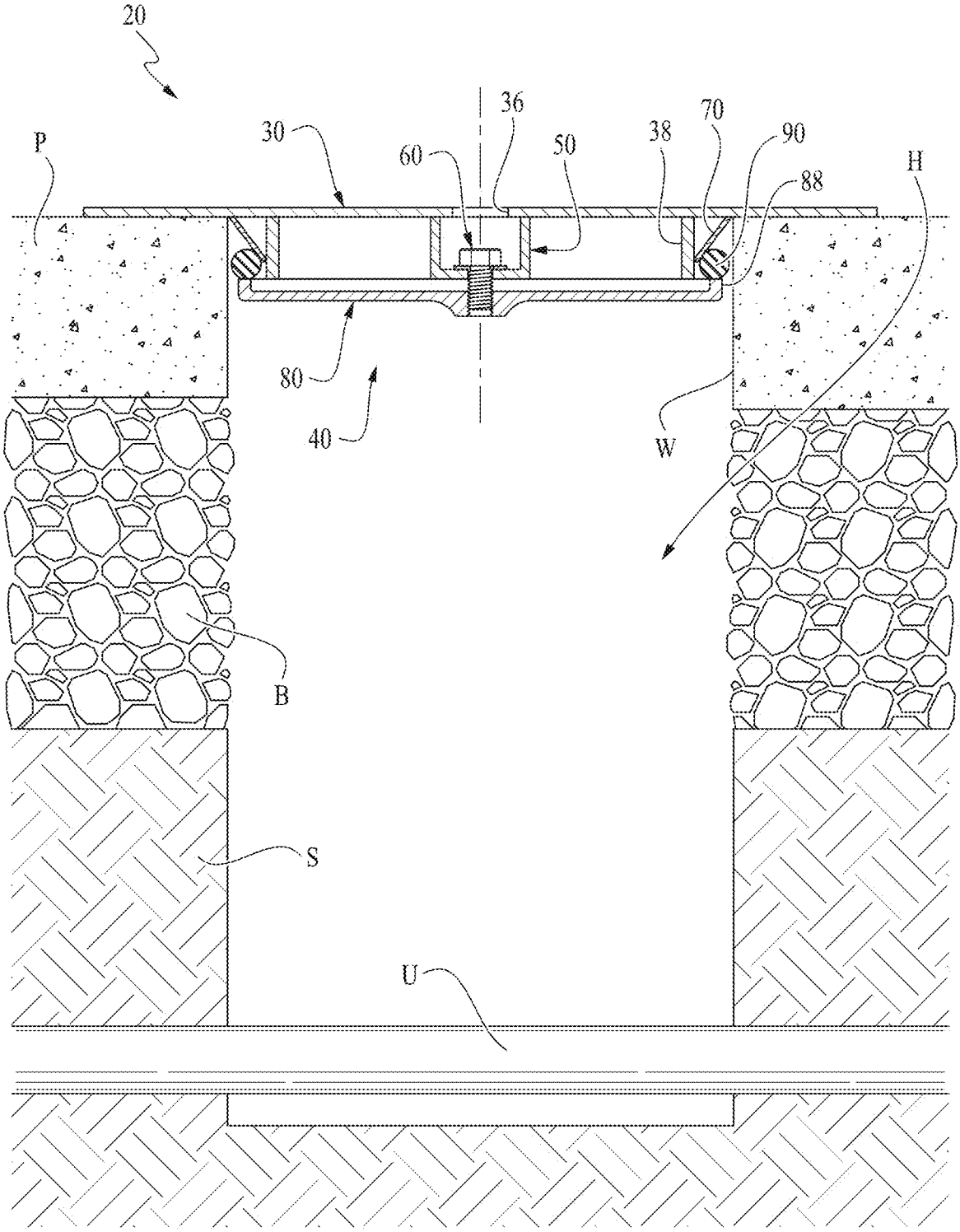
FIG. 4 is a reduced scale side view of the selectively frictionally engaged hole cover of FIG. 1, showing the selectively frictionally engaged hole cover inserted within a bore hole formed through a paved surface in the unengaged configuration.
Figure 5:
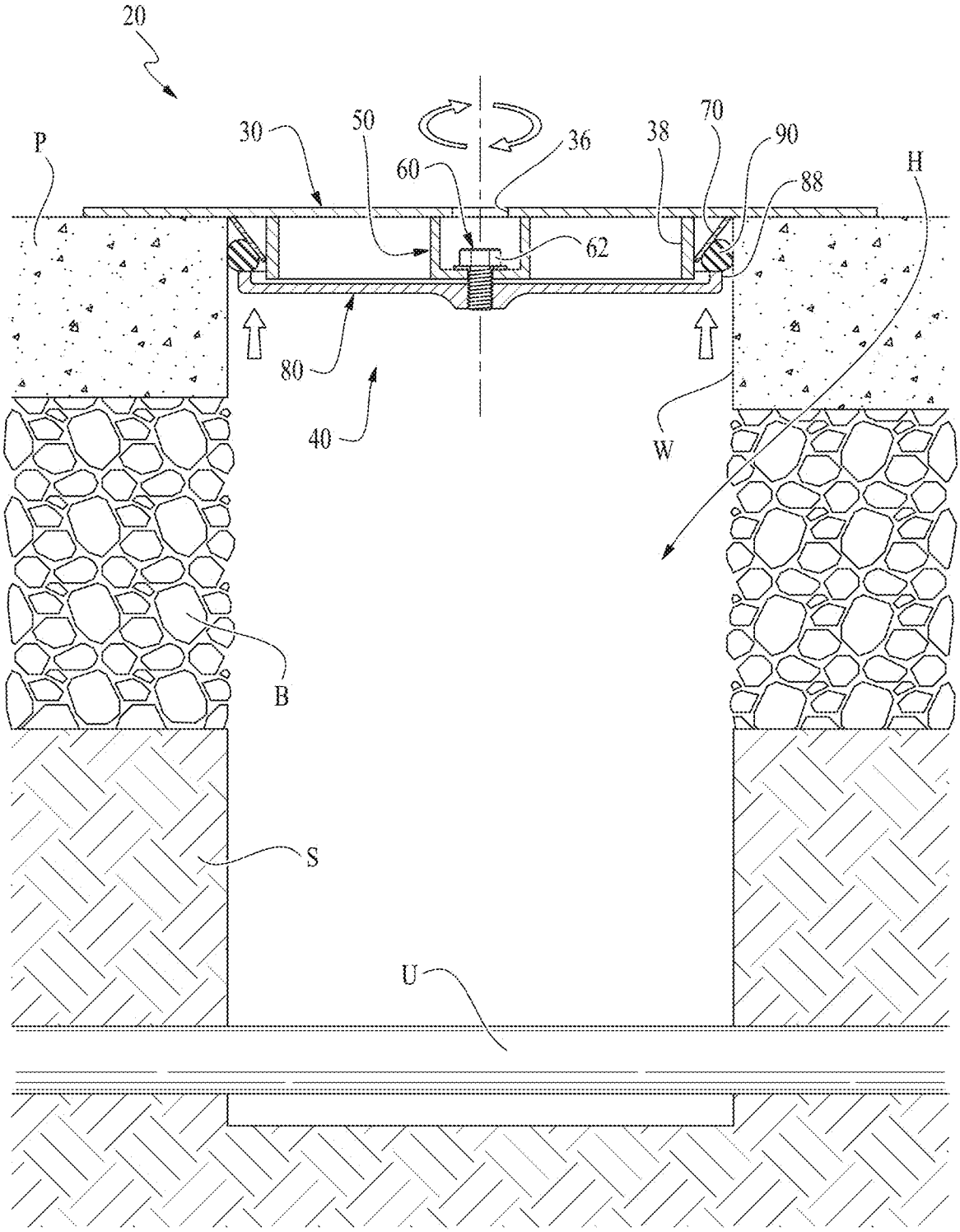
FIG. 5 is a reduced scale side view of the selectively frictionally engaged hole cover of FIG. 1, showing the selectively frictionally engaged hole cover inserted within a bore hole formed through a paved surface in the engaged configuration.

As shown in FIGS. 4 & 5, the insertion and engagement procedures, respectively, of selectively frictionally engaged hole cover 20 can be seen. Bore hole H is formed by coring through a paved surface P (e.g., asphalt, concrete, or other form of paved surface appropriate for supporting vehicular traffic on a roadway, parking lot, or other area). Bore hole H is further dug through any other layers beneath paved surface P, such as the illustrated base B or subgrade S layers, until a utility U is sufficiently exposed.

Referring to FIG. 4, selectively frictionally engaged hole cover 20 is positioned over bore hole H, with engagement mechanism 40 inserted within bore hole H and cover plate 30 resting on top of paved surface P. Once selectively frictionally engaged hole cover 20 is properly positioned, engagement member 90 is inserted within bore hole B and positioned adjacent to bore hole wall W here in the vicinity of or at the level of paved surface P.

Turning to FIG. 5, head 62 of engagement screw 60 is rotated in a clockwise direction using an appropriate tool to provide the required torque, from the point of view of the user standing on top of paved surface P. This clockwise rotation causes engagement plate 80 to move upward on engagement screw 60, thus lifting engagement member 90 up and against engagement member stop 70 of cover plate 30 and so shifting engagement member 90 radially or laterally outwardly into contact with bore hole wall W of bore hole H. In this way, the frictional engagement between engagement member 90 and bore hole wall W creates a mechanical interference that prohibits extraction of selectively frictionally engaged hole cover 20 from bore hole H, even under maximum expected vehicular traffic conditions, such as class one vehicles (under 6,000 pounds) up to and exceeding class eight vehicles (over 33,000 pounds) traveling at highway speeds. To remove selectively frictionally engaged hole cover 20, a user simply rotates head 62 of engagement screw 60 in the counterclockwise direction to shift engagement plate 80 downwardly and thus allow engagement member 90 to shift downwardly and away from inwardly sloped engagement member stop 70 and thus radially or laterally inwardly so as to disengage from or come out of contact with bore hole wall W as shown in FIG. 4.

While a particular configuration of selectively frictionally engaged hole cover 20 and thus of cover plate 30 and engagement mechanism 40 is shown and described, it will be appreciated by those skilled in the art that the invention is not so limited and other configurations and related assembly and operability arrangements are possible according to aspects of the present invention without departing from its spirit and scope. By way of illustration and not limitation, the sizes and shapes of the various components can vary, and particularly engagement member 90, while shown and described as an annular gasket or o-ring, may take other forms; or gasket-type member 90 may be sized and configured to itself not frictionally engage bore hole wall W but instead to support other operably coupled engagement members configured, for example, as curved tabs or pads or other surfaces that in cooperation with engagement member 90 are selectively forced radially or laterally outwardly and into frictional contact or engagement with bore hole wall W as they are lifted along engagement member stop 70 of engagement mechanism 40 by upward movement of engagement plate 80, which tabs or pads or the like may be configured to grip bore hole wall W and include a radius similar to bore hole H radius. Regardless, those skilled in the art will appreciate that selectively frictionally engaged hole cover 20 according to aspects of the present invention is a relatively simple mechanical arrangement with fewer mechanical or moving components, thereby reducing or eliminating potential failure points, and also a relatively more compact design for better storage efficiency.

It will be appreciated by those skilled in the art that by having contact about all or substantially all the circumference or between the perimeter of engagement mechanism 40 and specifically engagement member 90 and bore hole wall W, selectively frictionally engaged hole cover 20 according to aspects of the present invention is less susceptible to shifting and maintains its orientation in bore hole H, versus other designs that might tend to get point loaded when cars and trucks drive over. Relatedly, the present invention by making perimeter contact or frictionally engaging bore hole wall W at numerous points of contact does not dig into bore hole wall W even while sufficiently engaging bore hole wall W to prevent unwanted dislodging or removal of selectively frictionally engaged hole cover 20, thereby not compromising the integrity of bore hole H even as selectively frictionally engaged hole cover 20 is inserted and removed. It will be further appreciated that even at a relatively shallow depth within bore hole H, selectively frictionally engaged hole cover 20 is substantially secured within bore hole H even pre-actuation based on the close clearance between engagement member 90 and bore hole wall W.

Referring now to FIGS. 6-10, another example embodiment of the present selectively frictionally engaged hole cover 20 is disclosed, and again generally includes cover plate 30 with engagement mechanism 40 coupled thereto and extending from bottom surface 34 of cover plate 30.

Figure 7:
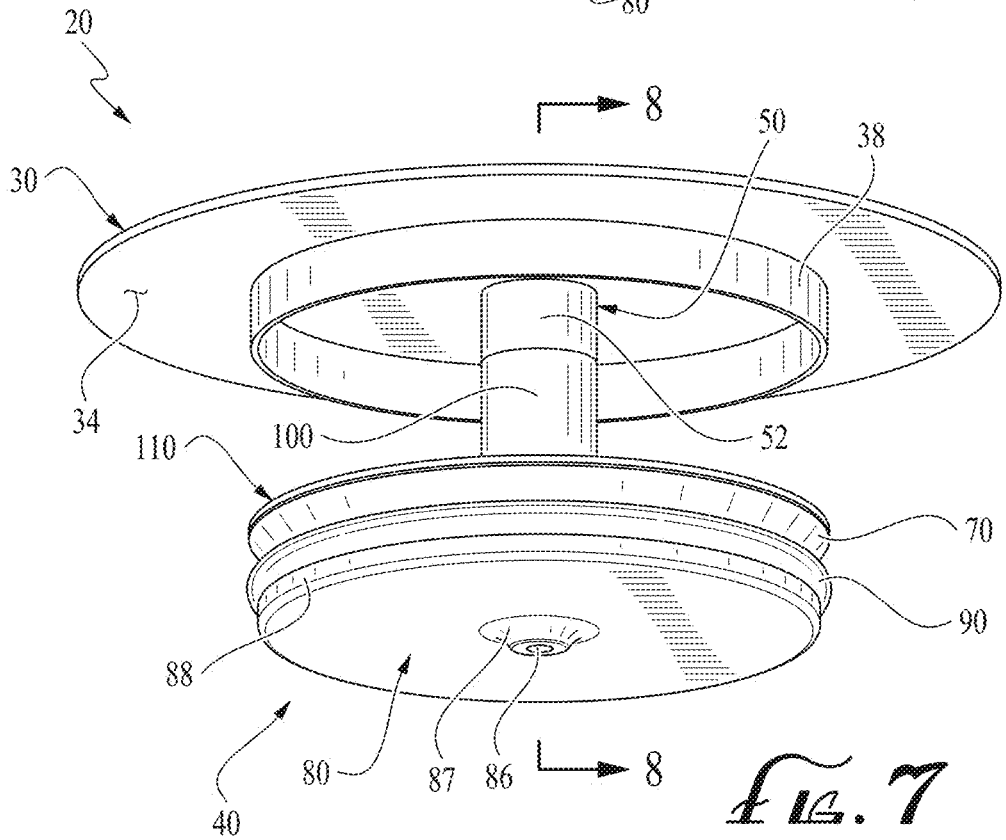
FIG. 7 is an assembled bottom perspective view of the anchored hole cover of FIG. 6.
Figure 8:
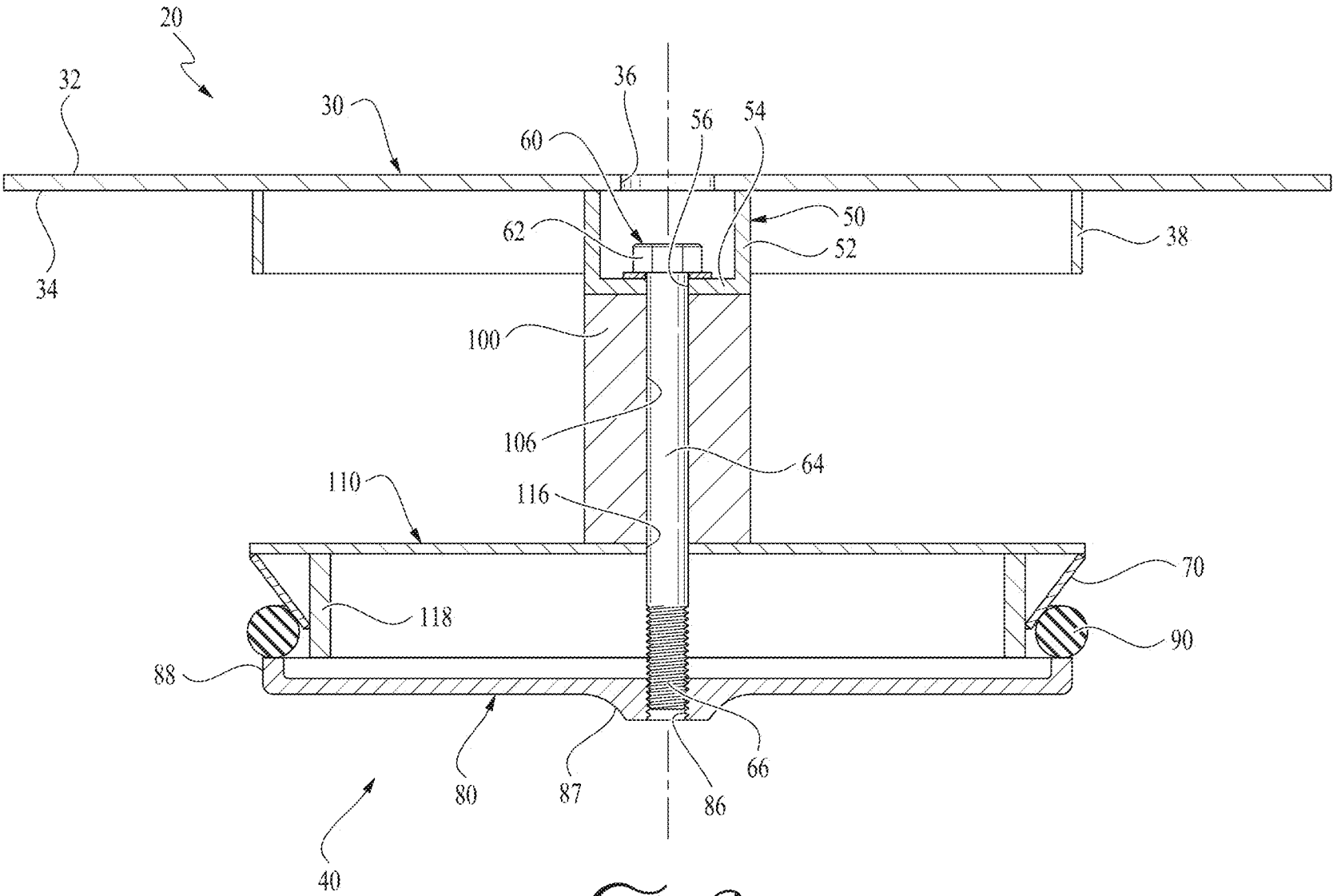
FIG. 8 is an enlarged side cross-sectional view of the selectively frictionally engaged hole cover of FIG. 6 taken from line 8-8 of FIG. 7.

Cover plate 30 is a circular plate having a diameter that is greater than engagement mechanism 40 and is sized larger than bore hole H so as to span and seat over bore hole H even as engagement mechanism 40 is seated within bore hole H. Cover plate 30 includes access hole 36 centrally located therein that communicates between top surface 32 and bottom surface 34 of cover plate 30. As best seen in FIGS. 7 & 8, cover plate 30 further compress cover plate skirt 38 which extends downwardly from bottom surface 34 of cover plate 30 and may be integral with or connected to cover plate 30 as by welding or otherwise. Positioned radially outwardly of central engagement support bracket 50, cover plate skirt 38 does not serve as a support for engagement member stop 70 but instead just as an upper or proximal retention or guide for selectively frictionally engaged hole cover 20 as the entire assembly is positioned within bore hole H. This configuration ensures that the relatively longer or taller selectively frictionally engaged hole cover 20 does not get cocked as it is being inserted within bore hole H and that cover plate 30 is substantially centered over bore hole H as cover plate 30 rests on paved surface P.

Figure 6:
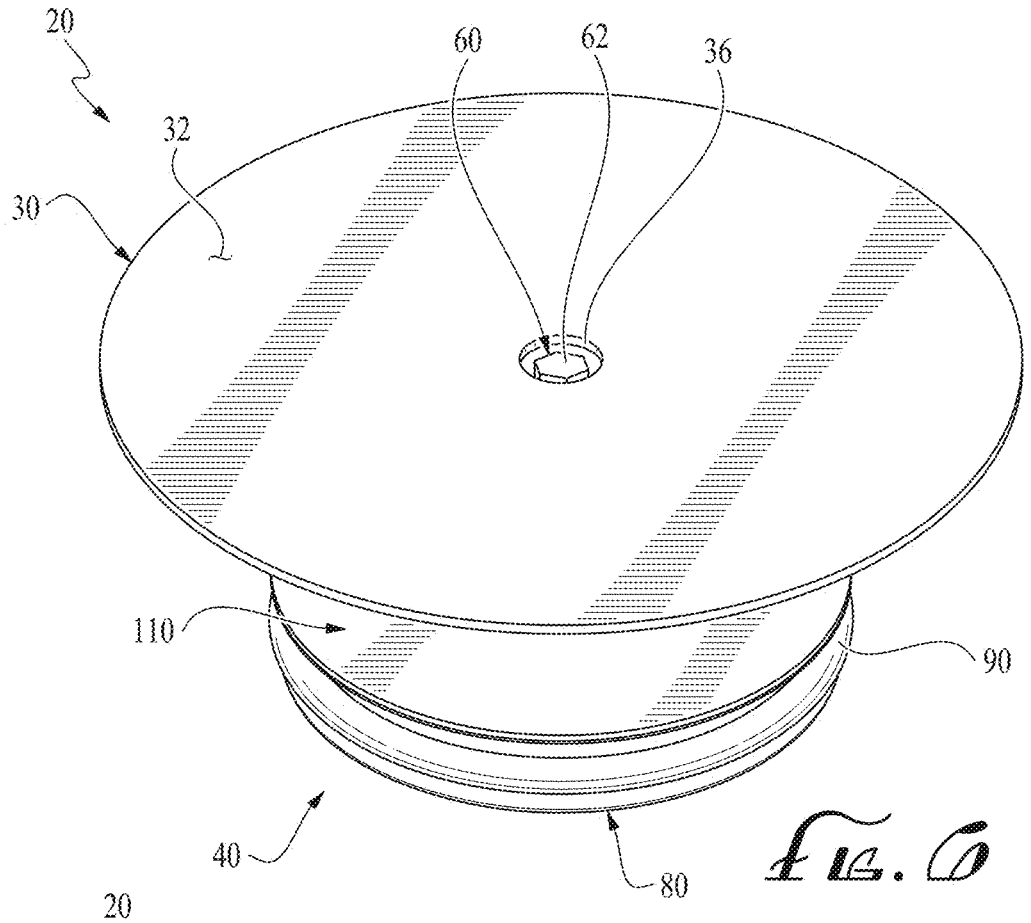
FIG. 6 is an assembled top perspective view of another exemplary embodiment of a selectively frictionally engaged hole cover disclosed herein.

As shown in FIGS. 6-8, engagement mechanism 40 again comprises engagement support bracket 50, engagement screw 60, engagement plate 80, and engagement member 90. Engagement mechanism 40 once again generally includes engagement plate 80 operably spaced from and configured to shift up and down relative to bottom surface 34 of cover plate 30 so as to thereby cause engagement member 90 in contact with engagement plate 80 to selectively move up and down along engagement member stop 70 offset from engagement plate 80 and thus shift outwardly or inwardly radially or laterally.

Engagement support bracket 50 extends from bottom surface 34 (i.e., facing into the bore hole H when installed)

substantially centered about access hole 36, the engagement support bracket 50 having an annular bracket sidewall 52 terminating in a support plate 54 spaced from bottom surface 34 of cover plate 30 and having a support plate hole 56 formed therein offset from and substantially aligned with access hole 36 of cover plate 30. Bracket sidewall 52 may be attached to bottom surface 34 of cover plate 30 at its top edge, for example, as by welding the top edge to bottom surface 34, and similarly support plate 54 may be integral with or connected to bracket sidewall 52 by welding or other appropriate means now known or later developed.

As shown in FIGS. 7 & 8, in this alternative embodiment, a stand-off 100 is provided between cover plate 30 and engagement plate 80 so as to space the two further apart. Stand-off 100 is aligned with and adjacent to support plate 54 and extends downwardly or distally therefrom. Stand-off 100 has its own through-hole 106 aligned with support plate hole 56, Opposite of support plate 54, stand-off 100 engages a retainer plate 110 that is substantially parallel to cover plate 30 and support plate 80, with retainer plate 110 again joined to stand-off 100 via welding or any other appropriate attachment technique now known or later developed.

As best seen in FIGS. 7 & 8, retainer plate 110 is a circular plate having a diameter and includes centrally located access hole 116 that communicates between a top surface 112 and a bottom surface 114 of retainer plate 110. Retainer plate 110 further comprises retainer plate skirt 118 and engagement member 90. Retainer plate skirt 118 extends downward or distally from bottom surface 114 of retainer plate 110 (i.e., facing into bore hole H when installed), and may be integral with or connected to retainer plate 110 as by welding or otherwise. Engagement member stop 70 spans between an outer surface of retainer plate skirt 118 and bottom surface 114 of retainer plate 110 to form an annular angled or sloped wall. Engagement member stop 70 can be integral with or connected to bottom surface 114 of retainer plate 110 and retainer plate skirt 118 as by welding or otherwise.

Engagement screw 60 is still operably installed between cover plate 30 and engagement plate 80. As best seen in FIG. 8, engagement screw 60 again has head 62 configured to pass through access hole 36 and seat on support plate 54 and here has a relatively longer shank 64 configured to pass through support plate hole 56 as well as through-hole 106 of stand-off 100 and axially aligned retainer plate hole 116 to enable distal threaded portion 66 to threadably engage threaded hole 86 of engagement plate 80. Rotation of engagement screw 60 as by operably engaging head 62 via access hole 36 with an appropriate tool thereby selectively raises or lowers engagement plate 80 relative to retainer plate 110 as rotation or torque is applied to engagement screw 60. In one or more embodiments, an appropriate tool includes, without limitation, a socket wrench, a T-handle wrench, a speed or crack handle wrench, an impact wrench, and numerous other hand or power tools that can be used to impart a torque. Thus, upon actuation (applied through a user torque input), engagement screw 60 rotates and amplifies the magnitude of the torque and/or converts the torque to generally radial or lateral movement of engagement member 90 (e.g., movement toward/from bore hole wall W).

Engagement plate 80 is a circular plate having a diameter and includes centrally located threaded hole 86 that communicates between a top surface 82 and a bottom surface 84 of engagement plate 80 and perimeter lip 88 extending substantially perpendicular from top surface 82 and surrounding an outer perimeter edge of engagement plate 80. A raised boss 87 may be formed about threaded hole 86 simply to provide for more material thickness where threaded hole 86 is formed in engagement plate 80. Perimeter lip 88 and may be integral with or connected to engagement plate 80 as by welding, adhesives or with the use fasteners, such as, e.g., screws or rivets. Perimeter lip 88 supports engagement member 90 vertically or from beneath and selectively shift engagement member 90 upwardly along engagement member stop 70 of retainer plate 100 and thus radially outwardly as engagement plate 80 is shifted upwardly due to rotation of engagement screw 60. Engagement plate 80 and thus the annular position of perimeter lip 88 is substantially vertically aligned with the center of engagement member 90 and the midline of engagement member stop 70. In addition, the outer diameters of cover plate skirt 38, retainer plate 100, and engagement member 90 are approximately equal, As such, the outer annular alignment or general profile of engagement mechanism 40 substantially conforms to or is slightly smaller than or insets from the respective bore hole wall W.

Engagement member 90 may be formed as an annular gasket or o-ring having a nominal or "at rest" diameter approximately the same as or slightly larger than that of retainer plate skirt 118 and having a degree of elasticity so as to stretch and expand as engagement member 90 transitions along engagement member stop 70 that effectively provides an expanding or increasing diameter on which engagement member 90 seats. Engagement member 90 has a diameter configured to align with the midline of engagement member stop 70.

Figure 9:
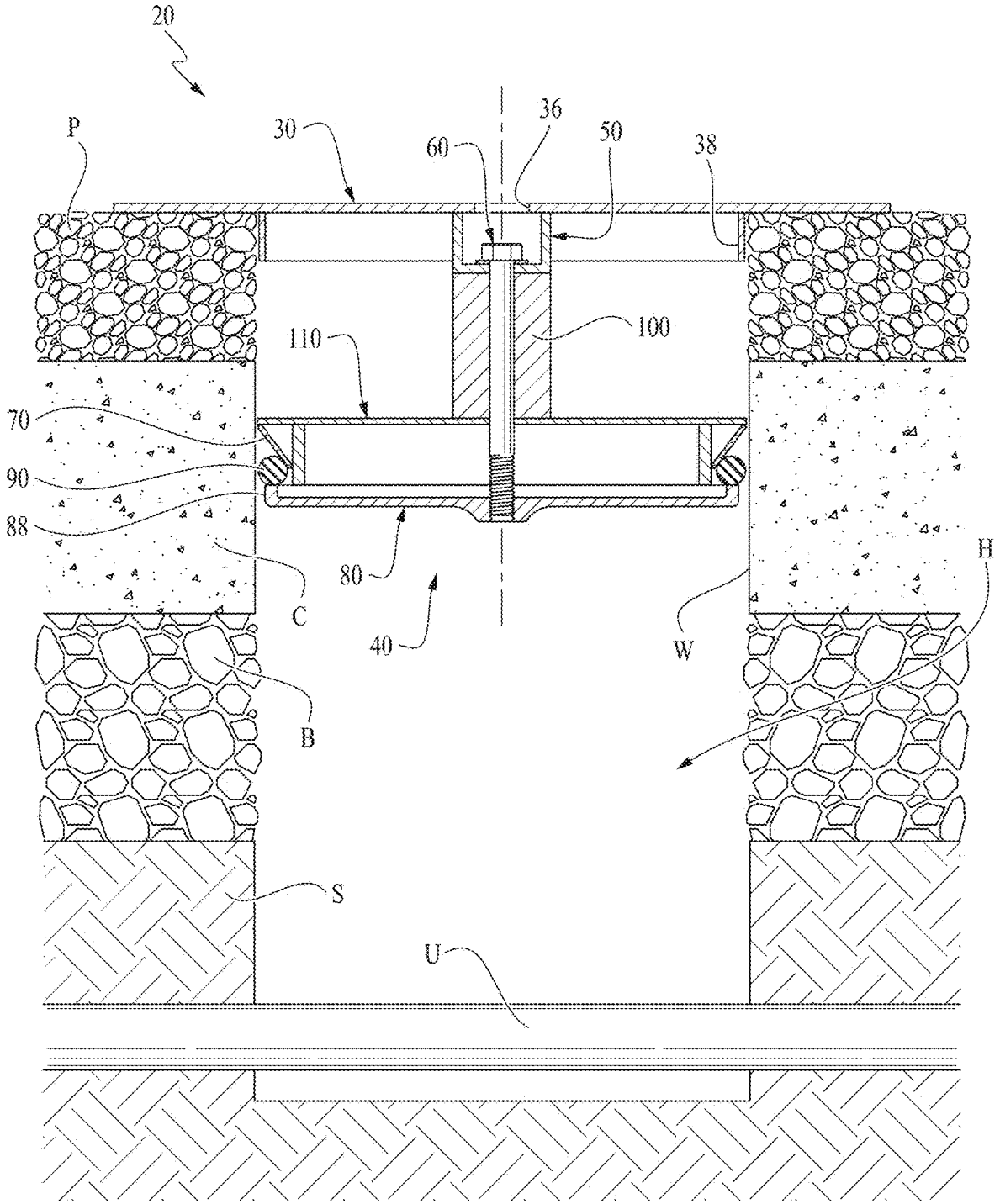
FIG. 9 is a reduced scale side view of the selectively frictionally engaged hole cover of FIG. 6, showing the selectively frictionally engaged hole cover inserted within a bore hole formed through a paved surface in the unengaged configuration.
Figure 10:
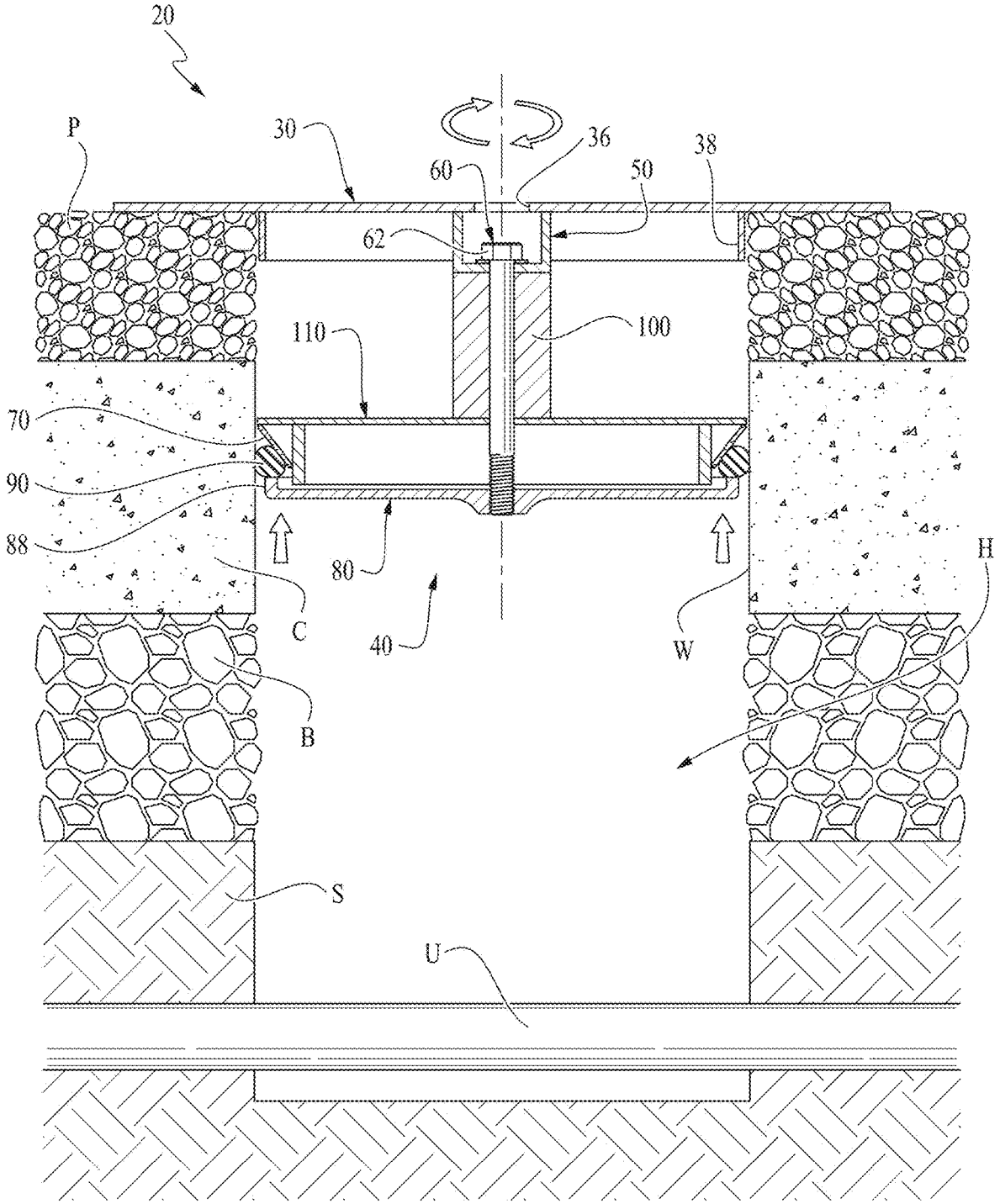
FIG. 10 is a reduced scale side view of the selectively frictionally engaged hole cover of FIG. 6, showing the selectively frictionally engaged hole cover inserted within a bore hole formed through a paved surface in the engaged configuration.
Figure 11:
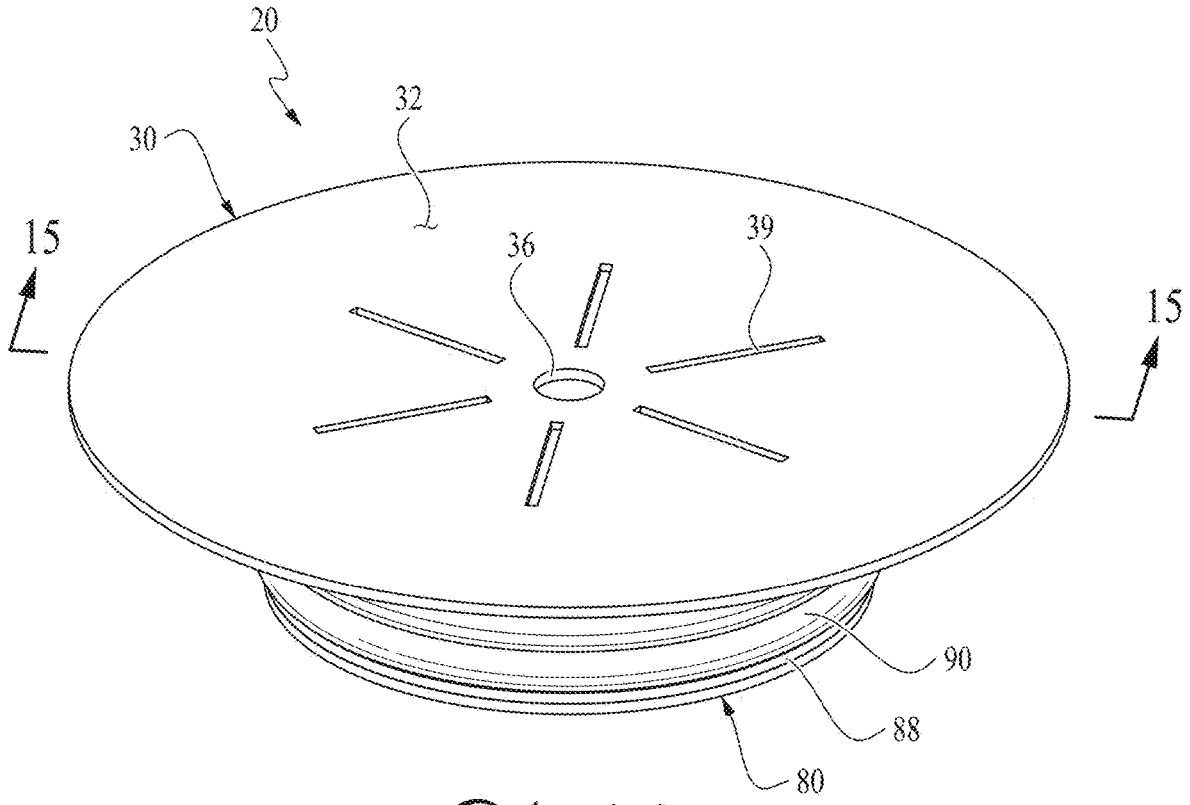
FIG. 11 is an assembled top perspective view of an exemplary embodiment of a selectively frictionally engaged hole cover disclosed herein.
Figure 12:
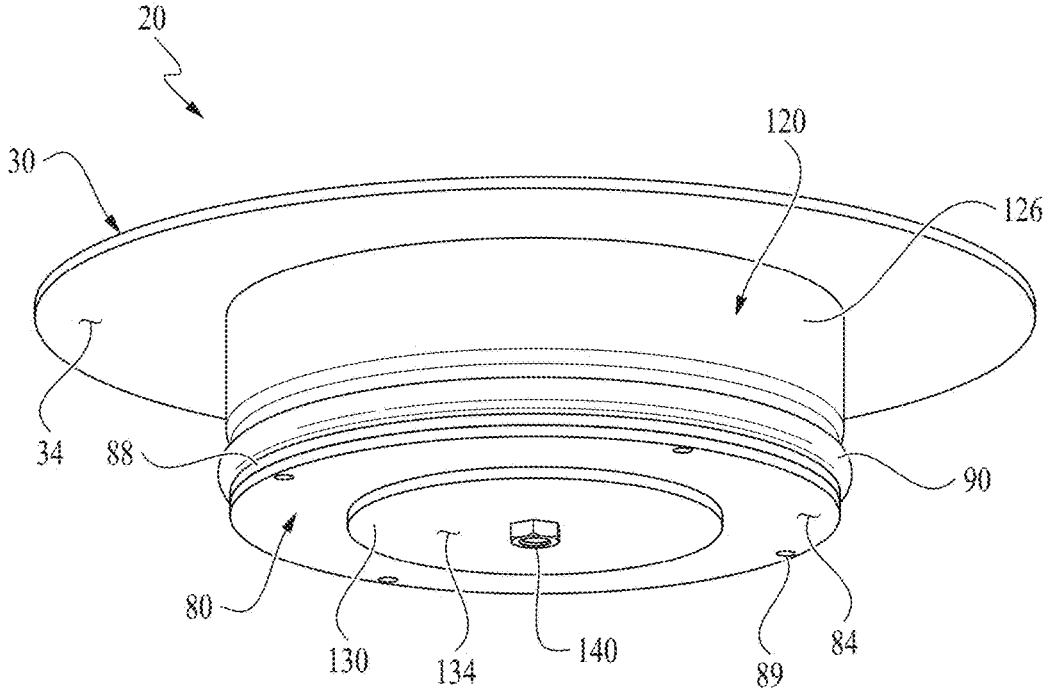
FIG. 12 is an assembled bottom perspective view of the selectively frictionally engaged hole cover of FIG. 11.

As shown in FIGS. 9 & 10, the insertion and engagement procedures, respectively, of selectively frictionally engaged hole cover 20 can be seen. Bore hole H is again formed by coring through paved surface P (e.g., asphalt, concrete, or other form of paved surface appropriate for supporting vehicular traffic on a roadway, parking lot, or other area). Bore hole H is further dug through any other layers beneath paved surface P, such as illustrated intermediate course C and base B or subgrade S layers, until utility U is sufficiently exposed. Notably, as illustrated, uppermost paved surface P may in some cases be a concrete or aggregate or other material that is relatively coarse beneath which may be intermediate layer or course C that is relatively finer and so may provide a relatively smoother bore hole wall W for engagement mechanism 40 and specifically engagement member 90 to selectively seat against and frictionally engage. In use, selectively frictionally engaged hole cover 20 with stand-off 100 for increased height or increased depth of positioning engagement mechanism 40 and engagement member 90 specifically within bore hole H. More generally, it will be appreciated that the deeper engagement mechanism 40 is inserted within bore hole H, the better the retention of hole cover 20, regardless of the layers and the characteristics of bore hole wall W at various depths.

Referring to FIG. 9, selectively frictionally engaged hole cover 20 is positioned over bore hole H with engagement mechanism 40 inserted within bore hole H and the cover plate 30 resting on top of paved surface P. Once selectively frictionally engaged hole cover 20 is properly positioned, engagement member 90 is inserted within bore hole B and positioned adjacent to bore hole wall W here in the vicinity of or at the level of intermediate course C.

Turning to FIG. 10, head 62 of engagement screw 60 is rotated in a clockwise direction using an appropriate tool to provide the required torque, from the point of view of a user standing on top of paved surface P. This clockwise rotation causes engagement plate 80 to move upward on engagement screw 60, thus lifting engagement member 90 up and against engagement member stop 70 of retaining plate 110 and so shifting engagement member 90 radially or laterally outwardly into contact with bore hole wall W of bore hole H. In this way, the frictional engagement between engagement member 90 and bore hole wall W creates a mechanical interference that prohibits extraction of selectively frictionally engaged hole cover 20 from bore hole H, even under maximum expected vehicular traffic conditions, such as class one vehicles (under 6,000 pounds) up to and exceeding class eight vehicles (over 33,000 pounds) traveling at highway speeds. To remove selectively frictionally engaged hole cover 20, a user simply rotates head 62 of engagement screw 60 in the counterclockwise direction to shift engagement plate 80 downwardly and thus allow engagement member 90 to shift downwardly and away from inwardly sloped engagement member stop 70 and thus radially or laterally inwardly so as to disengage from or come out of contact with bore hole wall W as shown in FIG. 9.

It will again be appreciated by those skilled in the art that by having contact about all or substantially all the circumference or between the perimeter of the engagement mechanism 40 and specifically engagement member 90 and bore hole wall W, selectively frictionally engaged hole cover 20 according to aspects of the present invention is less susceptible to shifting and maintains its orientation in bore hole H, versus other designs that might tend to get point loaded when cars and trucks drive over. Relatedly, the present invention by making perimeter contact or frictionally engaging bore hole wall W at numerous points of contact does not dig into it even while sufficiently engaging bore hole wall W to prevent unwanted dislodging or removal of selectively frictionally engaged hole cover 20, thereby not compromising the integrity of bore hole H even as selectively frictionally engaged hole cover 20 is inserted and removed. It will be further appreciated that even at a relatively shallow depth within bore hole H, and certainly even more so at increased depth as in the alternative exemplary embodiment, selectively frictionally engaged hole cover 20 is substantially secured within bore hole H even pre-actuation based on the close clearance between engagement member 90 and bore hole wall W. Indeed, selectively frictionally engaged hole cover 20 according to aspects of the present invention, whether short (FIGS. 1-5) or long (FIGS. 6-10), is well suited to capping or covering a variety of other holes, such as in walls and other support structures and not just horizontal surfaces such as roads and the like.

While a particular configuration of selectively frictionally engaged hole cover 20 and thus of cover plate 30 and engagement mechanism 40 is shown and described, it will be appreciated by those skilled in the art that the invention is not so limited and other configurations and related assembly and operability arrangements are possible according to aspects of the present invention without departing from its spirit and scope. By way of illustration and not limitation, the sizes and shapes of the various components can vary, and particularly engagement member 90, while shown and described as an annular gasket or o-ring, may take other forms; or gasket-type member 90 may be sized and configured to itself not frictionally engage bore hole wall W but instead to support other operably coupled engagement members configured, for example, as curved tabs or pads or other surfaces that in cooperation with engagement member 90 are selectively forced radially or laterally outwardly and into frictional contact or engagement with bore hole wall W as they are lifted along engagement member stop 70 of engagement mechanism 40 by upward movement of engagement plate 80, which tabs or pads or the like may be configured to grip bore hole wall W and include a radius similar to bore hole H radius. Regardless, those skilled in the art will appreciate that selectively frictionally engaged hole cover 20 according to aspects of the present invention is a relatively simple mechanical arrangement with fewer mechanical or moving components, thereby reducing or eliminating potential failure points, and also a relatively more compact design for better storage efficiency.

Referring now to FIGS. 11-17, another example embodiment of the present selectively frictionally engaged hole cover 20 is disclosed, and again generally includes cover plate 30 with engagement mechanism 40 coupled thereto and extending from bottom surface 34 of cover plate 30.

As shown in FIGS. 11-15, cover plate 30 is a circular plate having a diameter that is greater than engagement mechanism 40 and is sized larger than bore hole H so as to span and seat over bore hole H even as engagement mechanism 40 is seated within bore hole H. Cover plate 30 includes access hole 36 centrally located therein that communicates between top surface 32 and bottom surface 34 of cover plate 30. Cover plate 30 further includes slots 39.

As shown in FIGS. 11-15, engagement mechanism 40 again comprises engagement support bracket 50, engagement screw 60, engagement plate 80, and engagement member 90. Engagement mechanism 40 once again has engagement plate 80 operably spaced from and configured to shift up and down relative to bottom surface 34 of cover plate 30 so as to thereby cause engagement member 90 in contact with engagement plate 80 to selectively move up and down along engagement member stop 70 offset from engagement plate 80 and thus shift outwardly or inwardly radially or laterally.

Engagement support bracket 50 extends from bottom surface 34 (i.e., facing into the bore hole H when installed) substantially centered about access hole 36, engagement support bracket 50 having an annular bracket sidewall 52 terminating in a support plate 54 spaced from bottom surface 34 of cover plate 30 and having a support plate hole 56 formed therein offset from and substantially aligned with access hole 36 of cover plate 30. Bracket sidewall 52 may be attached to bottom surface 34 of cover plate 30 at its top edge, for example, as by welding the top edge to bottom surface 34, and similarly support plate 54 may be integral with or connected to bracket sidewall 52 by welding or other appropriate means now known or later developed. Engagement support bracket 50 further comprises one or more bracing ribs 58 (with six illustrated in FIG. 13) extending radially from bracket sidewall 52. Bracing ribs 58 are used to provide additional stability to engagement mechanism 40 and may be integral with or connected to bracket sidewall 52 by welding or other appropriate means now known or later developed.

Figure 13:
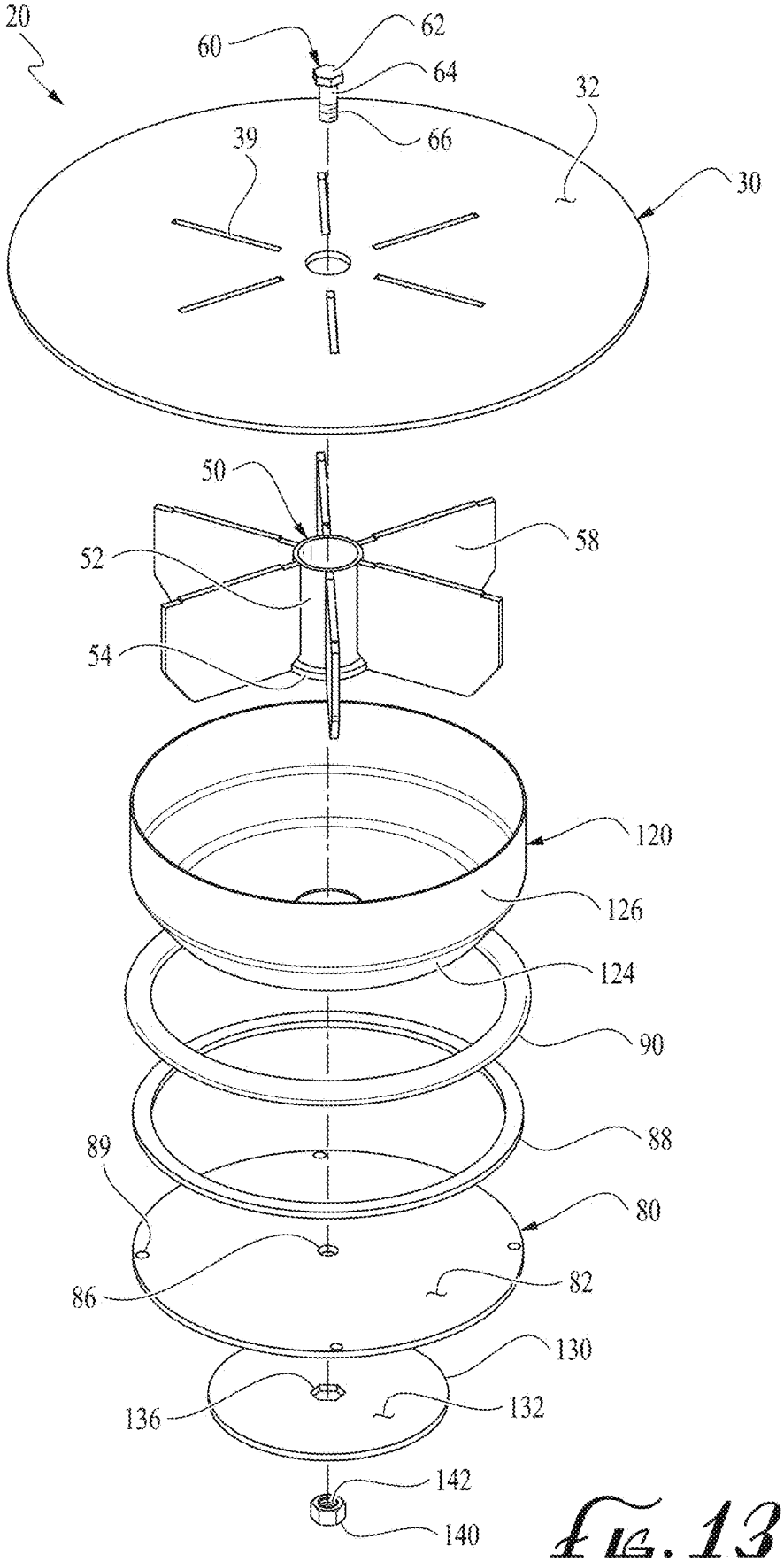
FIG. 13 is an exploded top perspective view of of a selectively frictionally engaged hole cover of FIG. 11.
Figure 14:
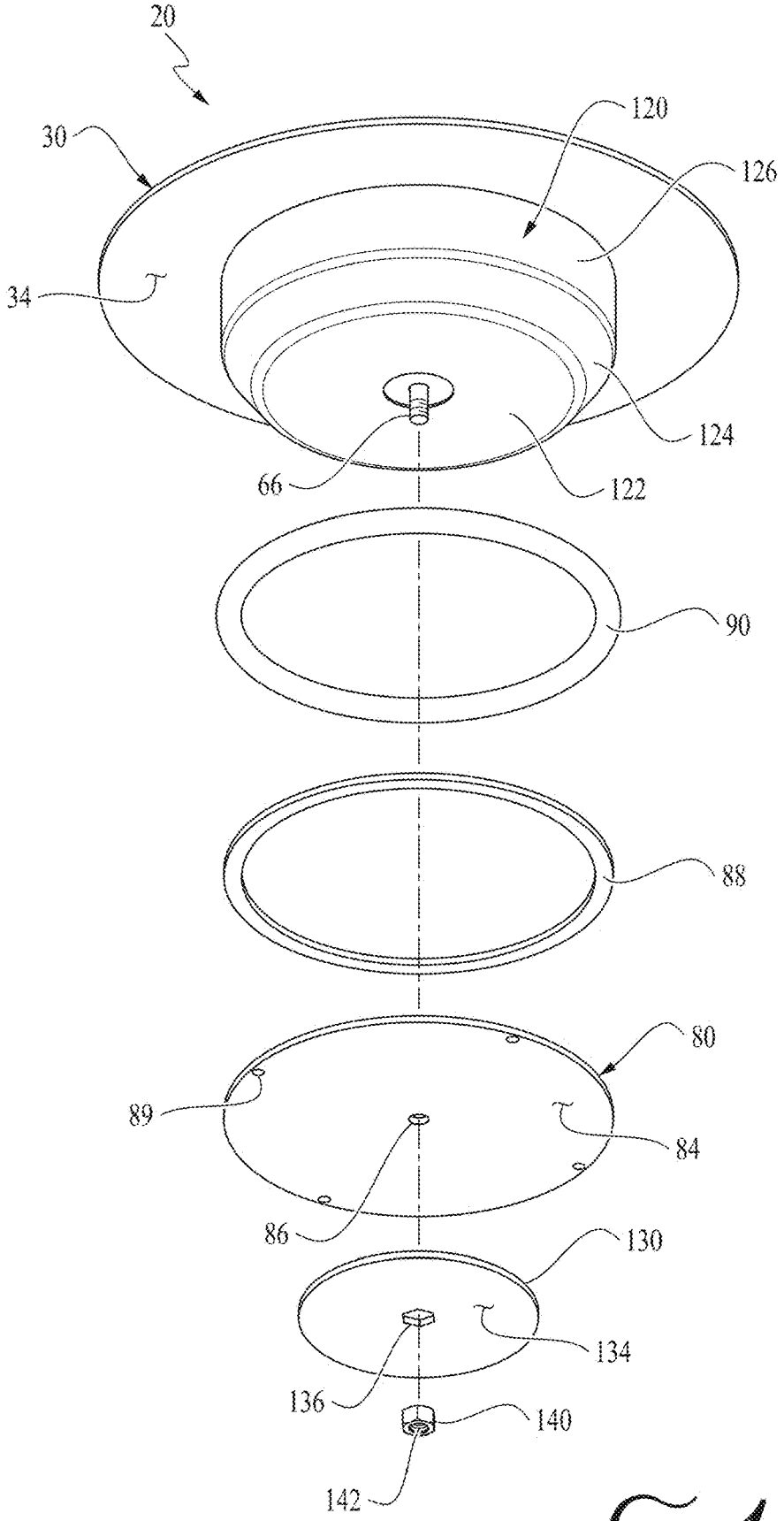
FIG. 14 is an exploded bottom perspective view of the selectively frictionally engaged hole cover of FIG. 11.
Figure 15:
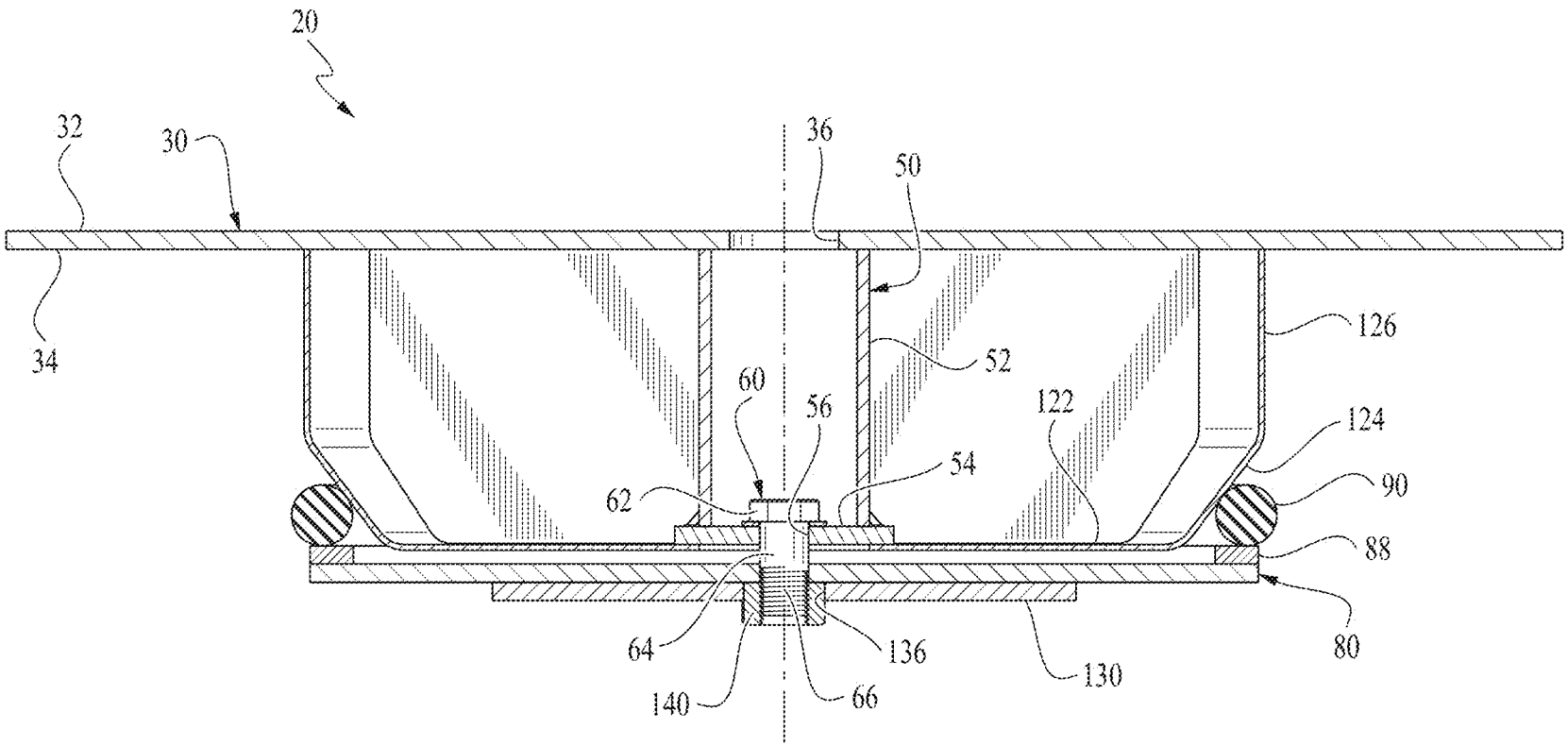
FIG. 15 is an enlarged side cross-sectional view of the selectively frictionally engaged hole cover of FIG. 11 taken from line 15-15.

As shown in FIGS. 13-15, in this alternative embodiment, a bracket housing 120 is provided between cover plate 30 and engagement plate 80 so as to space the two further apart. Bracket housing 120 is bowl-shaped having a flat bottom portion 122, an angular angled portion 124 that extends at an upward and outward angle from bottom portion 122 to form a sloped wall, and a skirt portion 126 that extends from angled portion 124 and is substantially perpendicular to bottom portion 122. A through-hole 128 is centrally positioned on bottom portion 122. Angled portion 124 of bracket housing 120 functions as and is equivalent to engagement member stop 70 whereas skirt portion 126 of bracket housing 120 functions as and is equivalent to cover plate skirt 38 and serves as an upper or proximal retention or guide for selectively frictionally engaged hole cover 20 as the entire assembly is positioned within bore hole H.

As best seen in FIG. 15, engagement support bracket 50 is contained within bracket housing 120 in a manner that aligned support plate hole 56 to through-hole 128. Bracket housing 120 may be attached to bottom surface 34 of cover plate 30 at its top edge, for example, as by welding or other appropriate means now known or later developed, that centrally positions bracket housing 120 to cover plate 30 at in a manner that encases engagement support bracket 50 within bracket housing 120 and aligns access hole 36, support plate hole 56, and through-hole 128. Additionally, bracket sidewall 52 can be attached to an inner surface of bottom portion 122 at its bottom edge, for example, as by welding the top edge to inner surface of bottom portion 122. Furthermore, one or more bracing ribs 58 can be attached to an inner surface of bottom portion 122 at a bottom edge of each bracing rib 58, and to an inner surface of angled portion 124 and skirt portion 126 at a side edge of each bracing rib 58.

Engagement screw 60 is still operably installed between cover plate 30 and engagement plate 80. As best seen in FIG. 15, engagement screw 60 again has head 62 configured to pass through access hole 36 and seat on support plate 54 and here has shank 64 configured to pass through support plate hole 56 as well as through-hole 128 of bracket housing 120 and axially aligned through-hole 86 of engagement plate 80 to enable distal threaded portion 66 to threadably engage a threaded through-hole 142 of a nut 140. Rotation of engagement screw 60 as by operably engaging head 62 via access hole 36 with an appropriate tool thereby selectively raises or lowers engagement plate 80 relative to bracket housing 120 as rotation or torque is applied to engagement screw 60. In one or more embodiments, an appropriate tool includes, without limitation, a socket wrench, a T-handle wrench, a speed or crack handle wrench, an impact wrench, and numerous other hand or power tools that can be used to impart a torque. Thus, upon actuation (applied through a user torque input), engagement screw 60 rotates and amplifies the magnitude of the torque and/or converts the torque to generally radial or lateral movement of engagement member 90 (e.g., movement toward/from bore hole wall W).

Engagement plate 80 is a circular plate having a diameter and includes centrally located through-hole 86 that communicates between a top surface 82 and a bottom surface 84 of engagement plate 80 and perimeter lip 88 extending substantially perpendicular from top surface 82 and surrounding an outer perimeter edge of engagement plate 80. Perimeter lip 88 includes one or more through-holes 89 (with four illustrated in FIG. 13). Perimeter lip 88 may be integral with or connected to engagement plate 80 as by welding, adhesives or with the use fasteners, such as, e.g., screws or rivets, inserted through through-hole 89 of engagement plate 80 and into a blind-hole on a bottom surface of perimeter lip 88. Perimeter lip 88 supports engagement member 90 vertically or from beneath and selectively shift engagement member 90 upwardly along engagement member stop 70 of retainer plate 100 and thus radially outwardly as engagement plate 80 is shifted upwardly due to rotation of engagement screw 60. Engagement plate 80 further comprises a reinforcement plate 130 and nut 140 having threaded through-hole 142. Reinforcement plate 130 is a circular plate having a diameter smaller than engagement plate 80 and includes centrally located nut seat 136 that communicates between a top surface 132 and a bottom surface 134 of reinforcement plate 130. Reinforcement plate 130 functions to increase the thickness of engagement plate 80 and spread the load outward toward engagement member 90. Nut seat 136 is sized to receive and hold nut 140 in place to prevent nut 140 from turning when engagement screw 60 is rotated. Engagement plate 80 and thus the annular position of perimeter lip 88 is substantially vertically aligned with the center of engagement member 90 and the midline of engagement member stop 70. In addition, the outer diameters of bracket housing 120 and engagement member 90 are approximately equal, As such, the outer annular alignment or general profile of engagement mechanism 40 substantially conforms to or is slightly smaller than or insets from the respective bore hole wall W.

Engagement member 90 may be formed as an annular gasket or o-ring having a nominal or "at rest" diameter approximately the same as or slightly larger than that of bracket housing 120 and having a degree of elasticity so as to stretch and expand as engagement member 90 transitions along engagement member stop 72 that effectively provides an expanding or increasing diameter on which engagement member 90 seats. Engagement member 90 has a diameter configured to align with the midline of engagement member stop 72.

Figure 16:
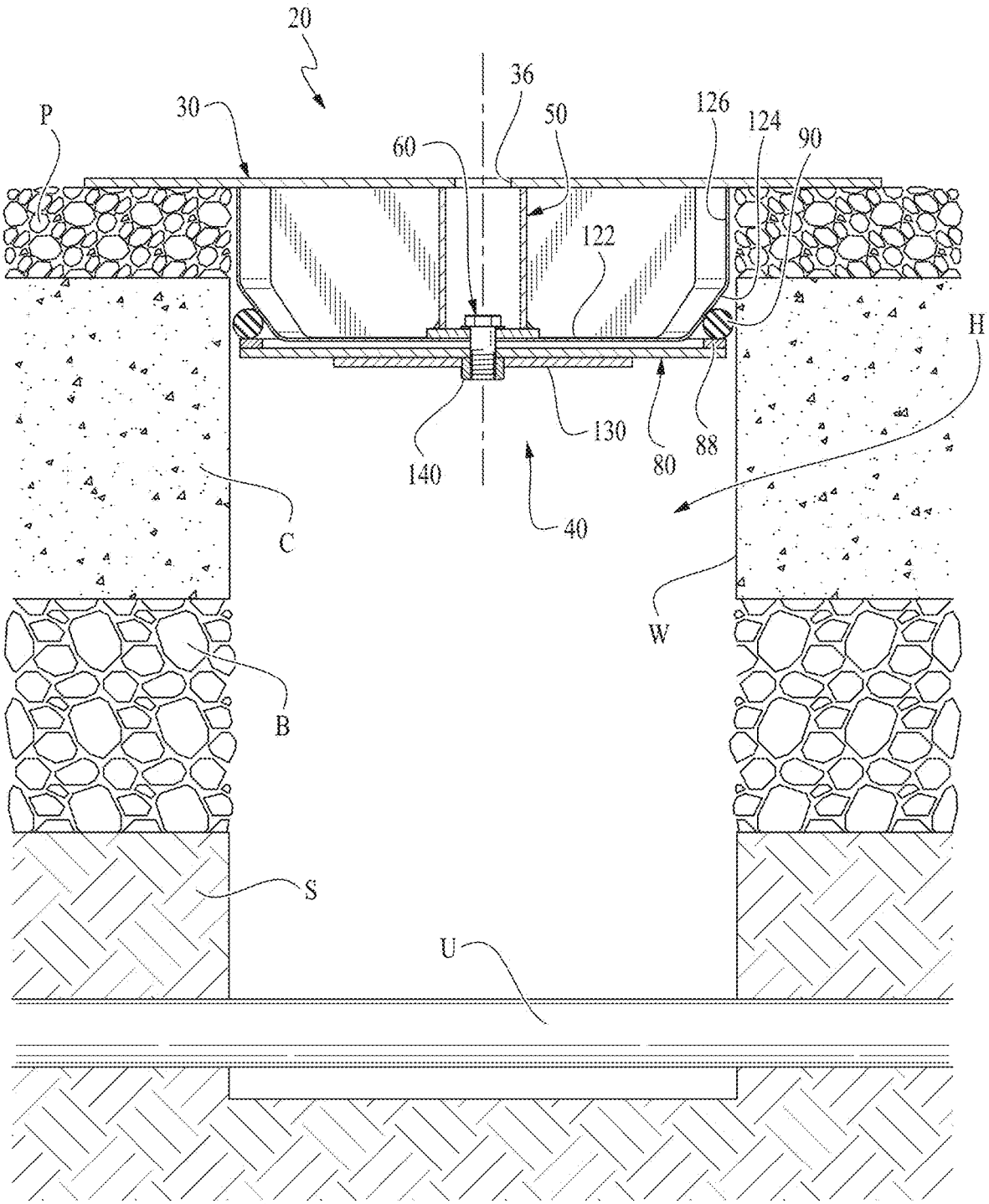
FIG. 16 is a reduced scale side view of the selectively frictionally engaged hole cover of FIG. 11, showing the selectively frictionally engaged hole cover inserted within a bore hole formed through a paved surface in the unengaged configuration.
Figure 17:
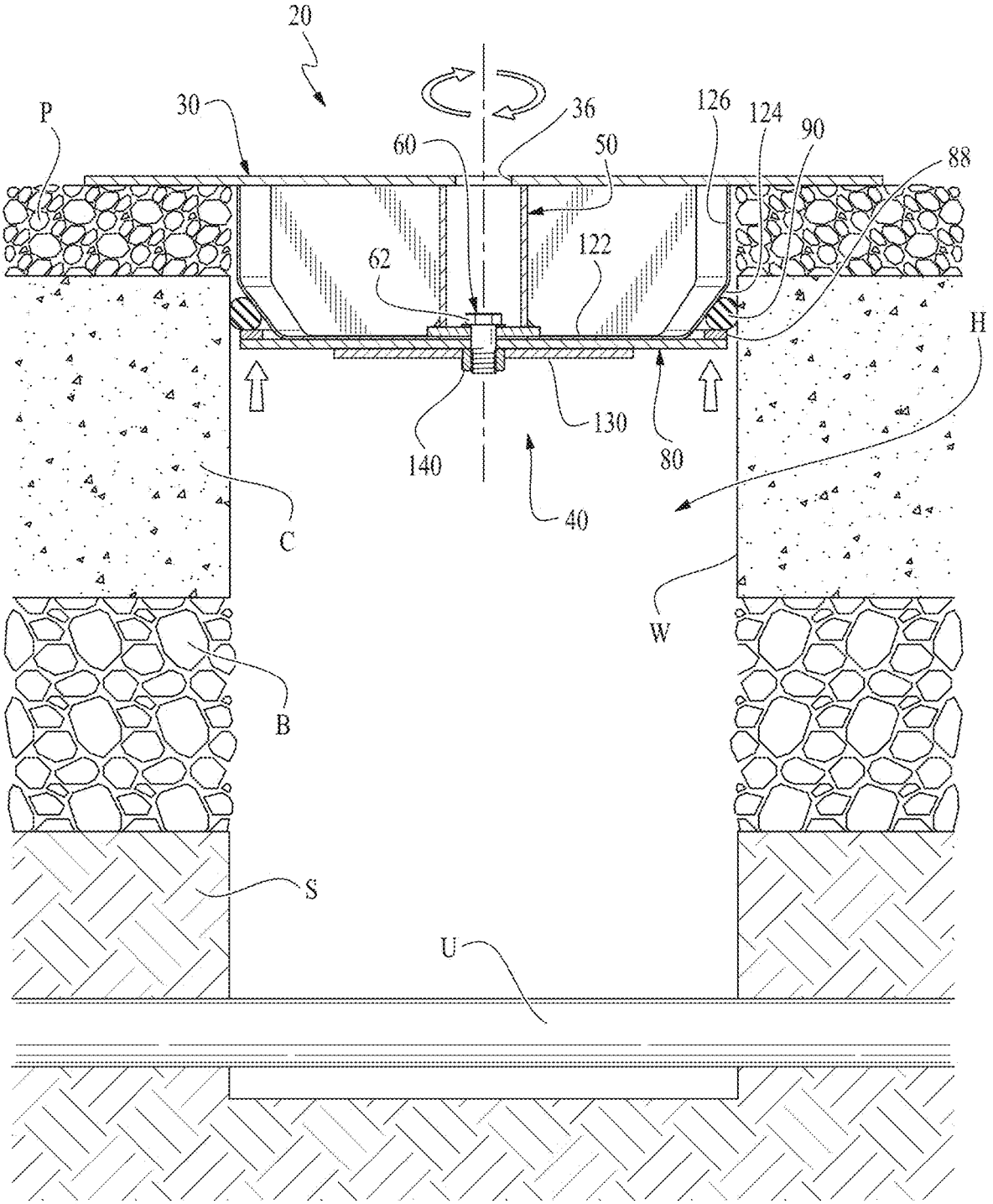
FIG. 17 is a reduced scale side view of the selectively frictionally engaged hole cover of FIG. 11, showing the selectively frictionally engaged hole cover inserted within a bore hole formed through a paved surface in the engaged configuration.

As shown in FIGS. 16 & 17, the insertion and engagement procedures, respectively, of selectively frictionally engaged hole cover 20 can be seen. Bore hole H is again formed by coring through paved surface P (e.g., asphalt, concrete, or other form of paved surface appropriate for supporting vehicular traffic on a roadway, parking lot, or other area). Bore hole H is further dug through any other layers beneath paved surface P, such as illustrated intermediate course C and base B or subgrade S layers, until utility U is sufficiently exposed. Notably, as illustrated, uppermost paved surface P may in some cases be a concrete or aggregate or other material that is relatively coarse beneath which may be intermediate layer or course C that is relatively finer and so may provide a relatively smoother bore hole wall W for engagement mechanism 40 and specifically engagement member 90 to selectively seat against and frictionally engage. In use, selectively frictionally engaged hole cover 20 with bracket housing 120 increases height or depth of positioning engagement mechanism 40 and engagement member 90 specifically within bore hole H. More generally, it will be appreciated that the deeper engagement mechanism 40 is inserted within bore hole H, the better the retention of hole cover 20, regardless of the layers and the characteristics of bore hole wall W at various depths.

Referring to FIG. 16, selectively frictionally engaged hole cover 20 is positioned over bore hole H with engagement mechanism 40 inserted within bore hole H and the cover plate 30 resting on top of paved surface P. Once selectively frictionally engaged hole cover 20 is properly positioned, engagement member 90 is inserted within bore hole B and positioned adjacent to bore hole wall W here in the vicinity of or at the level of intermediate course C.

Turning to FIG. 17, head 62 of engagement screw 60 is rotated in a clockwise direction using an appropriate tool to provide the required torque, from the point of view of a user standing on top of paved surface P. This clockwise rotation causes engagement plate 80 to move upward on engagement screw 60, thus lifting engagement member 90 up and against engagement member stop 72 of retaining plate 110 and so shifting engagement member 90 radially or laterally outwardly into contact with bore hole wall W of bore hole H. In this way, the frictional engagement between engagement member 90 and bore hole wall W creates a mechanical interference that prohibits extraction of selectively frictionally engaged hole cover 20 from bore hole H, even under maximum expected vehicular traffic conditions, such as class one vehicles (under 6,000 pounds) up to and exceeding class eight vehicles (over 33,000 pounds) traveling at highway speeds. To remove selectively frictionally engaged hole cover 20, a user simply rotates head 62 of engagement screw 60 in the counterclockwise direction to shift engagement plate 80 downwardly and thus allow engagement member 90 to shift downwardly and away from inwardly sloped engagement member stop 72 and thus radially or laterally inwardly so as to disengage from or come out of contact with bore hole wall W as shown in FIG. 16.

It will again be appreciated by those skilled in the art that by having contact about all or substantially all the circumference or between the perimeter of the engagement mechanism 40 and specifically engagement member 90 and bore hole wall W, selectively frictionally engaged hole cover 20 according to aspects of the present invention is less susceptible to shifting and maintains its orientation in bore hole H, versus other designs that might tend to get point loaded when cars and trucks drive over. Relatedly, the present invention by making perimeter contact or frictionally engaging bore hole wall W at numerous points of contact does not dig into it even while sufficiently engaging bore hole wall W to prevent unwanted dislodging or removal of selectively frictionally engaged hole cover 20, thereby not compromising the integrity of bore hole H even as selectively frictionally engaged hole cover 20 is inserted and removed. It will be further appreciated that even at a relatively shallow depth within bore hole H, and certainly even more so at increased depth as in the alternative exemplary embodiment, selectively frictionally engaged hole cover 20 is substantially secured within bore hole H even pre-actuation based on the close clearance between engagement member 90 and bore hole wall W. Indeed, selectively frictionally engaged hole cover 20 according to aspects of the present invention, whether short (FIGS. 1-5) or long (FIGS. 6-10), is well suited to capping or covering a variety of other holes, such as in walls and other support structures and not just horizontal surfaces such as roads and the like.

While a particular configuration of selectively frictionally engaged hole cover 20 and thus of cover plate 30 and engagement mechanism 40 is shown and described, it will be appreciated by those skilled in the art that the invention is not so limited and other configurations and related assembly and operability arrangements are possible according to aspects of the present invention without departing from its spirit and scope. By way of illustration and not limitation, the sizes and shapes of the various components can vary, and particularly engagement member 90, while shown and described as an annular gasket or o-ring, may take other forms; or gasket-type member 90 may be sized and configured to itself not frictionally engage bore hole wall W but instead to support other operably coupled engagement members configured, for example, as curved tabs or pads or other surfaces that in cooperation with engagement member 90 are selectively forced radially or laterally outwardly and into frictional contact or engagement with bore hole wall W as they are lifted along engagement member stop 72 of engagement mechanism 40 by upward movement of engagement plate 80, which tabs or pads or the like may be configured to grip bore hole wall W and include a radius similar to bore hole H radius. Regardless, those skilled in the art will appreciate that selectively frictionally engaged hole cover 20 according to aspects of the present invention is a relatively simple mechanical arrangement with fewer mechanical or moving components, thereby reducing or eliminating potential failure points, and also a relatively more compact design for better storage efficiency.

In one or more example embodiments, the cover plate 30 is made of steel plate material sufficiently strong and thick to support heavy vehicular traffic thereupon. The weight bearing capacity of the cover plate 30 is up to 10,000 pounds, or up to 20,000 pounds, or up to 30,000 pounds, or up to 40,000 pounds, or up to 50,000 pounds, or up to 60,000 pounds, or up to 70,000 pounds, or up to 80,000 pounds, or up to 90,000 pounds, or up to or exceeding 100,000 pounds.

In one or more example embodiments, the engagement mechanism 40 is sufficiently strong to resist an extraction force up to 1,000 pounds, or up to 3,000 pounds, or up to 5,000 pounds, or up to 7,000 pounds, or up to or exceeding 10,000 pounds.

Aspects of the present specification may also be described by the following numbered embodiments:

1. A selectively frictionally engaged hole cover for covering a bore hole formed through a paved surface, the selectively frictionally engaged hole cover comprising: a cover plate having a top surface and a bottom surface opposite the top surface, the top surface being configured to support safe passage of pedestrians and vehicular traffic across the selectively frictionally engaged hole cover; and an engagement mechanism coupled with the cover plate and extending from the bottom surface of the cover plate, the engagement mechanism having an engagement plate selectively shiftable relative to the cover plate and configured to thereby shift an engagement member along a engagement member stop and thus radially outwardly or inwardly; wherein, during an insertion procedure, the engagement mechanism is configured to be positioned within the bore hole and supported at least initially therein by the cover plate that is configured to rest upon the paved surface and substantially cover the bore hole; and wherein, during an engagement procedure, the engagement mechanism is configured to be actuated to cause a first movement of the engagement plate so as to shift the engagement member along the engagement member stop radially outwardly to move the engagement member into frictional contact with the bore hole to substantially prevent extraction of the engagement mechanism from the bore hole and to substantially prevent lifting of the cover plate due to forces exerted by vehicular traffic thereupon.
2. The selectively frictionally engaged hole cover of embodiment 1, wherein, during a disengagement procedure, the engagement mechanism is configured to be actuated to cause a second movement of the engagement plate so as to shift the engagement member along the engagement member stop radially inwardly to allow the engagement member to move out of frictional contact with the bore hole and permit extraction of the engagement mechanism from the bore hole.
3. The selectively frictionally engaged hole cover of embodiments 1 or 2, wherein the engagement mechanism further comprises a screw operably installed between the cover plate and the engagement plate, the screw having a head and a shank extending from the head, the shank having a threaded portion formed thereon opposite the head.
4. The selectively frictionally engaged hole cover of embodiment 3, wherein actuation of the engagement mechanism comprises rotation of the screw in a first rotational direction to cause the first movement and rotation of the screw in a second rotational direction opposite the first rotational direction to cause the second movement.

5. The selectively frictionally engaged hole cover of embodiments 3 or 4, wherein the cover plate further comprises an access hole, the head of the screw being situated substantially flush or below the top surface of the cover plate and sufficiently aligned with the access hole to permit actuation of the screw through the access hole.
6. The selectively frictionally engaged hole cover of embodiment 5, wherein the cover plate further comprises an engagement mechanism support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the screw while the head of the screw seats on the support plate.
7. The selectively frictionally engaged hole cover of embodiment 6, wherein a stand-off is installed adjacent to the support plate of the engagement mechanism support bracket, the stand-off having a through-hole for receipt therethrough of the shank of the screw, the shank having sufficient length to pass out of the through-hole of the stand-off.
8. The selectively frictionally engaged hole cover of embodiment 7, wherein a retainer plate is installed adjacent to the stand-off opposite the support plate of the engagement mechanism support bracket, the retainer plate having a retainer plate hole sufficiently aligned with the through-hole of the stand-off for receipt therethrough of the shank of the screw.
9. The selectively frictionally engaged hole cover of embodiment 8, wherein the engagement member stop is installed so as to extend downwardly and inwardly from the retainer plate, whereby the engagement member shifts up and down along the engagement member stop and thus radially outwardly and inwardly as the engagement plate shifts up and down relative to the retainer plate.
10. The selectively frictionally engaged hole cover of embodiment 9, wherein a retainer plate skirt is formed extending downwardly from the retainer plate, and further wherein the engagement member stop is configured at an angle spanning between the retainer plate and the retainer plate skirt.
11. The selectively frictionally engaged hole cover of any of embodiments 8-10, wherein the outer edge of the retainer plate and the outer edge of the engagement member are substantially vertically aligned.
12. The selectively frictionally engaged hole cover of any one of embodiments 3-11, wherein the engagement plate comprises a substantially central threaded hole for selective receipt of the threaded portion of the screw.
13. The selectively frictionally engaged hole cover of embodiment 12, wherein the engagement plate further comprises a boss in which the threaded hole is formed.
14. The selectively frictionally engaged hole cover of any one of embodiments 1-13, wherein a cover plate skirt is formed extending downwardly from the bottom surface of the cover plate.
15. The selectively frictionally engaged hole cover of embodiment 14, wherein the engagement member stop is configured at an angle spanning between the cover plate and the cover plate skirt.
16. The selectively frictionally engaged hole cover of embodiment 14, wherein the cover plate skirt and the outer edge of the engagement member are substantially vertically aligned.
17. The selectively frictionally engaged hole cover of any one of embodiments 1-16, wherein the engagement plate comprises a perimeter lip oriented to contact the engagement member in shifting the engagement member along the engagement member stop as the engagement plate is shifted relative to the cover plate.
18. A selectively frictionally engaged hole cover for covering a bore hole formed through a paved surface, the selectively frictionally engaged hole cover comprising: a cover plate having a top surface and a bottom surface opposite the top surface, the top surface being configured to support safe passage of pedestrians and vehicular traffic across the selectively frictionally engaged hole cover, the cover plate further having a cover plate skirt formed extending downwardly from the bottom surface of the cover plate; and an engagement mechanism coupled with the cover plate and extending from the bottom surface of the cover plate, the engagement mechanism having an engagement plate selectively shiftable relative to the cover plate, the engagement mechanism further having a screw operably installed between the cover plate and the engagement plate, the screw having a head and a shank extending from the head, the shank having a threaded portion formed thereon opposite the head, the engagement plate having a substantially central threaded hole for selective receipt of the threaded portion of the screw, the engagement mechanism further having a engagement member stop configured at an angle spanning between the cover plate and the cover plate skirt, the engagement mechanism further having an engagement member in contact with both the engagement plate and the engagement member stop, the engagement plate configured to thereby shift the engagement member along the engagement member stop and thus radially outwardly or inwardly as the engagement plate shifts relative to the cover plate; wherein, during an insertion procedure, the engagement mechanism is configured to be positioned within the bore hole and supported at least initially therein by the cover plate that is configured to rest upon the paved surface and substantially cover the bore hole; and wherein, during an engagement procedure, the engagement mechanism is configured to be actuated as by rotation of the screw in a first rotational direction to cause a first movement of the engagement plate so as to shift the engagement member along the engagement member stop radially outwardly to move the engagement member into frictional contact with the bore hole to substantially prevent extraction of the engagement mechanism from the bore hole and to substantially prevent lifting of the cover plate due to forces exerted by vehicular traffic thereupon; and further wherein, during a disengagement procedure, the engagement mechanism is configured to be actuated as by rotation of the screw in a second rotational direction opposite the first rotational direction to cause a second movement of the engagement plate so as to shift the engagement member along the engagement member stop radially inwardly to allow the engagement member to move out of frictional contact with the bore hole and permit extraction of the engagement mechanism from the bore hole.

19. A selectively frictionally engaged hole cover for covering a bore hole formed through a paved surface, the selectively frictionally engaged hole cover comprising: a cover plate having a top surface and a bottom surface opposite the top surface, the top surface being configured to support safe passage of pedestrians and vehicular traffic across the selectively frictionally engaged hole cover, the cover plate further having a cover plate skirt formed extending downwardly from the bottom surface of the cover plate; and an engagement mechanism coupled with the cover plate and extending from the bottom surface of the cover plate, the engagement mechanism having an engagement plate selectively shiftable relative to the cover plate, the engagement mechanism further having a screw operably installed between the cover plate and the engagement plate, the screw having a head and a shank extending from the head, the shank having a threaded portion formed thereon opposite the head, the engagement plate having a substantially central threaded hole for selective receipt of the threaded portion of the screw, the engagement mechanism further having a retainer plate spaced from the cover plate, wherein a stand-off couples the retainer plate to the cover plate, the stand-off having a through-hole for receipt therethrough of the shank of the screw, the shank having sufficient length to pass out of the through-hole of the stand-off, the engagement mechanism further having a engagement member stop extending downwardly and inwardly from the retainer plate, the engagement mechanism further having an engagement member in contact with both the engagement plate and the engagement member stop, the engagement plate configured to thereby shift the engagement member along the engagement member stop and thus radially outwardly or inwardly as the engagement plate shifts relative to the cover plate; wherein, during an insertion procedure, the engagement mechanism is configured to be positioned within the bore hole and supported at least initially therein by the cover plate that is configured to rest upon the paved surface and substantially cover the bore hole; and wherein, during an engagement procedure, the engagement mechanism is configured to be actuated as by rotation of the screw in a first rotational direction to cause a first movement of the engagement plate so as to shift the engagement member along the engagement member stop radially outwardly to move the engagement member into frictional contact with the bore hole to substantially prevent extraction of the engagement mechanism from the bore hole and to substantially prevent lifting of the cover plate due to forces exerted by vehicular traffic thereupon; and further wherein, during a disengagement procedure, the engagement mechanism is configured to be actuated as by rotation of the screw in a second rotational direction opposite the first rotational direction to cause a second movement of the engagement plate so as to shift the engagement member along the engagement member stop radially inwardly to allow the engagement member to move out of frictional contact with the bore hole and permit extraction of the engagement mechanism from the bore hole.

Aspects of the present specification may also be described by the following numbered embodiments:

1. A selectively frictionally engaged hole cover comprising a cover plate and an engagement mechanism: the cover plate having a top surface and a bottom surface opposite the top surface, the top surface being configured to support safe passage of pedestrians and vehicular traffic across the selectively frictionally engaged hole cover; and the engagement mechanism being coupled with the cover plate and extending from the bottom surface of the cover plate, the engagement mechanism comprising an engagement screw, an engagement plate, an engagement member, and an engagement member stop; the engagement screw operably installed between the cover plate and the engagement plate thereby attaching the cover plate to the engagement mechanism, the engagement screw having a head and a shank extending from the head, the shank having a threaded portion formed thereon opposite the head; and the engagement plate being selectively shiftable relative to the cover plate and configured to thereby shift the engagement member up and against the engagement member stop and thus radially outwardly or down and away from the engagement member stop and thus radially inwardly; wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.
2. The selectively frictionally engaged hole cover of embodiment 1, wherein actuation of the engagement mechanism comprises rotation of the engagement screw in a first rotational direction to cause the first movement and rotation of the engagement screw in a second rotational direction opposite the first rotational direction to cause the second movement.
3. The selectively frictionally engaged hole cover of embodiment 1 or 2, wherein, during an engagement procedure, the engagement mechanism is configured to be actuated to cause a first movement of the engagement plate so as to shift the engagement member up and against the engagement member stop to move the engagement member radially outwardly and into frictional contact with the bore hole to substantially prevent extraction of the engagement mechanism from the bore hole and to substantially prevent lifting of the cover plate due to forces exerted by vehicular traffic thereupon.
4. The selectively frictionally engaged hole cover of any one of embodiments 1-3, wherein, during a disengagement procedure, the engagement mechanism is configured to be actuated to cause a second movement of the engagement plate so as to shift the engagement member down and away from the engagement member stop to allow the engagement member to move radially inwardly and out of frictional contact with the bore hole and permit extraction of the engagement mechanism from the bore hole.
5. The selectively frictionally engaged hole cover of any one of embodiments 1-4, wherein the cover plate further comprises an access hole, the head of the engagement screw being situated substantially flush or below the top surface of the cover plate and sufficiently aligned with the access hole to permit actuation of the engagement screw through the access hole.
6. The selectively frictionally engaged hole cover of any one of embodiments 1-5, wherein the engagement plate comprises a substantially central threaded hole for selective receipt of the threaded portion of the engagement screw.

7. The selectively frictionally engaged hole cover of any one of embodiments 1-6, wherein the engagement plate comprises a perimeter lip oriented to contact the engagement member in shifting the engagement member along the engagement member stop as the engagement plate is shifted relative to the cover plate.
8. The selectively frictionally engaged hole cover of any one of embodiments 1-7, wherein the cover plate further comprises an engagement support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the engagement screw while the head of the engagement screw seats on the support plate.
9. The selectively frictionally engaged hole cover of embodiment 8, wherein a bracket housing is installed on the bottom surface of the cover plate thereby encasing the engagement support bracket.
10. The selectively frictionally engaged hole cover of embodiment 8 or 9, wherein the bracket housing is bowl-shaped has a flat bottom portion, an angular angled portion that extends at an upward and outward angle from bottom portion to form a sloped wall, and a skirt portion that extends from angled portion and is substantially perpendicular to bottom portion, wherein the angled portion functions as the engagement member stop.
11. The selectively frictionally engaged hole cover of any one of embodiments 8-10, wherein engagement support bracket further comprises one or more bracing ribs.
12. The selectively frictionally engaged hole cover of any one of embodiments 1-7, wherein a stand-off is installed adjacent to the support plate of the engagement support bracket, the stand-off having a through-hole for receipt therethrough of the shank of the engagement screw, the shank having sufficient length to pass out of the through-hole of the stand-off.
13. The selectively frictionally engaged hole cover of embodiment 12, wherein a retainer plate is installed adjacent to the stand-off opposite the support plate of the engagement support bracket, the retainer plate having a retainer plate hole sufficiently aligned with the through-hole of the stand-off for receipt therethrough of the shank of the engagement screw.
14. The selectively frictionally engaged hole cover of embodiment 12 or 13, wherein the engagement member stop is installed so as to extend downwardly and inwardly from the retainer plate, whereby the engagement member shifts up and down along the engagement member stop and thus radially outwardly and inwardly as the engagement plate shifts up and down relative to the retainer plate.
15. The selectively frictionally engaged hole cover of any one of embodiments 12-14, wherein a retainer plate skirt is formed extending downwardly from the retainer plate, and further wherein the engagement member stop is configured at an angle spanning between the retainer plate and the retainer plate skirt.
16. The selectively frictionally engaged hole cover of any one of embodiments 12-15, wherein the outer edge of the retainer plate and the outer edge of the engagement member are substantially vertically aligned.
17. The selectively frictionally engaged hole cover of any one of embodiments 1-7, wherein a cover plate skirt is formed extending downwardly from the bottom surface of the cover plate.
18. The selectively frictionally engaged hole cover of embodiment 17, wherein the engagement member stop is configured at an angle spanning between the cover plate and the cover plate skirt.
19. The selectively frictionally engaged hole cover of embodiment 17 or 18, wherein the cover plate skirt and the outer edge of the engagement member are substantially vertically aligned.
20. A selectively frictionally engaged hole cover comprising a cover plate, a bracket housing, and an engagement mechanism: the cover plate having a top surface and a bottom surface opposite the top surface, the top surface being configured to support safe passage of pedestrians and vehicular traffic across the selectively frictionally engaged hole cover; the bracket housing installed on the bottom surface of the cover plate and encasing a engagement support bracket, the bracket housing being bowl-shaped with a flat bottom portion, an angular angled portion that extends at an upward and outward angle from bottom portion to form a sloped wall, and a skirt portion that extends from angled portion and is substantially perpendicular to bottom portion, wherein the angled portion functions as an engagement member stop; and the engagement mechanism coupled with the cover plate and extending from the bottom surface of the cover plate, the engagement mechanism comprising an engagement screw, an engagement plate, and an engagement member; the engagement screw operably installed between the cover plate and the engagement plate thereby attaching the cover plate to the engagement mechanism, the engagement screw having a head and a shank extending from the head, the shank having a threaded portion formed thereon opposite the head; and the engagement plate having a substantially central threaded hole for selective receipt of the threaded portion of the engagement screw that enables selective shifting of the engagement plate relative to the cover plate and configured to thereby shift the engagement member up and against the engagement member stop and thus radially outwardly or down and away from the engagement member stop and thus radially inwardly; wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.
21. A selectively frictionally engaged hole cover comprising a cover plate and an engagement mechanism: the cover plate having a top surface and a bottom surface opposite the top surface, the top surface being configured to support safe passage of pedestrians and vehicular traffic across the selectively frictionally engaged hole cover and the cover plate comprising a cover plate skirt extending downwardly from the bottom surface of the cover plate and an engagement member stop configured at an angle spanning between the bottom surface of the cover plate and an outer surface of the cover plate skirt; and the engagement mechanism coupled with the cover plate and extending from the bottom surface of the cover plate, the engagement mechanism comprising an engagement screw, an engagement plate, and an engagement member; the engagement screw operably installed between the cover plate and the engagement plate thereby attaching the cover plate to the engagement mechanism, the engagement screw having a head and a shank extending from the head, the shank having a threaded portion formed thereon opposite the head; and the engagement plate having a substantially central threaded hole for selective receipt of the threaded portion of the engagement screw that enables selective shifting of the engagement plate relative to the cover plate and configured to thereby shift the engagement member up and against the engagement member stop and thus radially outwardly or down and away from the engagement member stop and thus radially inwardly; wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.

22. A selectively frictionally engaged hole cover comprising a cover plate and an engagement mechanism: the cover plate having a top surface and a bottom surface opposite the top surface, the top surface being configured to support safe passage of pedestrians and vehicular traffic across the selectively frictionally engaged hole cover; the engagement mechanism coupled with the cover plate and extending from the bottom surface of the cover plate, the engagement mechanism comprising an engagement screw, an engagement plate, an engagement member, a retainer plate, and a stand-off; the engagement screw operably installed between the cover plate and the engagement plate thereby attaching the cover plate to the engagement mechanism, the engagement screw having a head and a shank extending from the head, the shank having a threaded portion formed thereon opposite the head; and the retainer plate spaced from the cover plate, the retainer plate comprising a retainer plate skirt extending downwardly from the bottom surface of the retainer plate and an engagement member stop configured at an angle spanning between the bottom surface of the retainer plate and an outer surface of the retainer plate skirt; the stand-off couples the retainer plate to the cover plate, the stand-off having a through-hole for receipt therethrough of the shank of the engagement screw, the shank having sufficient length to pass out of the through-hole of the stand-off; and the engagement plate having a substantially central threaded hole for selective receipt of the threaded portion of the engagement screw that enables selective shifting of the engagement plate relative to the retainer plate and configured to thereby shift the engagement member up and against the engagement member stop and thus radially outwardly or down and away from the engagement member stop and thus radially inwardly; wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.

In closing, the foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions, and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions, and sub-combinations as are within their true spirit and scope. Accordingly, the scope of the present invention is not to be limited to that precisely as shown and described by this specification.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step, or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps or limitations may be made for any one of the elements, steps or limitations in a claim set forth below or that a single element, step, or limitation may be substituted for two or more elements, steps, or limitations in such a claim. Although elements, steps or limitations may be described above as acting in certain combinations and even initially claimed as such, it is to be expressly understood that one or more elements, steps or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more, or different elements, steps and/or limitations, which are disclosed in above even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. A selectively frictionally engaged hole cover comprising a cover plate and an engagement mechanism:

the cover plate having a top surface and a bottom surface opposite the top surface, the top surface being configured to support safe passage of pedestrians and vehicular traffic across the selectively frictionally engaged hole cover, the cover plate further comprising an engagement support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the engagement screw while the head of the engagement screw seats on the support plate; and the engagement mechanism being coupled with the cover plate and extending from the bottom surface of the cover plate, the engagement mechanism comprising an engagement screw, an engagement plate, an engagement member, and an engagement member stop;

the engagement screw operably installed between the cover plate and the engagement plate thereby attaching the cover plate to the engagement mechanism, the engagement screw having a head and a shank extending from the head, the shank having a threaded portion formed thereon opposite the head; and the engagement plate being selectively shiftable relative to the cover plate and configured to thereby shift the engagement member up and against the engagement member stop and thus radially outwardly or down and away from the engagement member stop and thus radially inwardly;

wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.

2. The selectively frictionally engaged hole cover of claim 1, wherein actuation of the engagement mechanism comprises rotation of the engagement screw in a first rotational direction to cause the first movement and rotation of the engagement screw in a second rotational direction opposite the first rotational direction to cause the second movement.

3. The selectively frictionally engaged hole cover of claim 1, wherein, during an engagement procedure, the engagement mechanism is configured to be actuated to cause a first movement of the engagement plate so as to shift the engagement member up and against the engagement member stop to move the engagement member radially outwardly and into frictional contact with the bore hole to substantially prevent extraction of the engagement mechanism from the bore hole and to substantially prevent lifting of the cover plate due to forces exerted by vehicular traffic thereupon.

4. The selectively frictionally engaged hole cover of claim 1, wherein, during a disengagement procedure, the engagement mechanism is configured to be actuated to cause a second movement of the engagement plate so as to shift the engagement member down and away from the engagement member stop to allow the engagement member to move radially inwardly and out of frictional contact with the bore hole and permit extraction of the engagement mechanism from the bore hole.

5. The selectively frictionally engaged hole cover of claim 1, wherein the cover plate further comprises an access hole, the head of the engagement screw being situated substantially flush or below the top surface of the cover plate and sufficiently aligned with the access hole to permit actuation of the engagement screw through the access hole.

6. The selectively frictionally engaged hole cover of claim 1, wherein the engagement plate comprises a substantially central threaded hole for selective receipt of the threaded portion of the engagement screw.

7. The selectively frictionally engaged hole cover of claim 1, wherein the engagement plate comprises a perimeter lip oriented to contact the engagement member in shifting the engagement member along the engagement member stop as the engagement plate is shifted relative to the cover plate.

8. The selectively frictionally engaged hole cover of claim 1, wherein a bracket housing is installed on the bottom surface of the cover plate thereby encasing the engagement support bracket.

9. The selectively frictionally engaged hole cover of claim 1, wherein engagement support bracket further comprises one or more bracing ribs.

10. The selectively frictionally engaged hole cover of claim 9, wherein the bracket housing is bowl-shaped has a flat bottom portion, an angular angled portion that extends at an upward and outward angle from bottom portion to form a sloped wall, and a skirt portion that extends from angled portion and is substantially perpendicular to bottom portion, wherein the angled portion functions as the engagement member stop.

11. The selectively frictionally engaged hole cover of claim 1, wherein a stand-off is installed adjacent to the support plate of the engagement support bracket, the stand-off having a through-hole for receipt therethrough of the shank of the engagement screw, the shank having sufficient length to pass out of the through-hole of the stand-off.

12. The selectively frictionally engaged hole cover of claim 11, wherein a retainer plate is installed adjacent to the stand-off opposite the support plate of the engagement support bracket, the retainer plate having a retainer plate hole sufficiently aligned with the through-hole of the stand-off for receipt therethrough of the shank of the engagement screw.

13. The selectively frictionally engaged hole cover of claim 12, wherein the engagement member stop is installed so as to extend downwardly and inwardly from the retainer plate, whereby the engagement member shifts up and down along the engagement member stop and thus radially outwardly and inwardly as the engagement plate shifts up and down relative to the retainer plate.

14. The selectively frictionally engaged hole cover of claim 12, wherein a retainer plate skirt is formed extending downwardly from the retainer plate, and further wherein the engagement member stop is configured at an angle spanning between the retainer plate and the retainer plate skirt.

15. The selectively frictionally engaged hole cover of claim 12, wherein the outer edge of the retainer plate and the outer edge of the engagement member are substantially vertically aligned.

16. The selectively frictionally engaged hole cover of claim 1, wherein a cover plate skirt is formed extending downwardly from the bottom surface of the cover plate and the engagement member stop is configured at an angle spanning between the cover plate and the cover plate skirt.

17. The selectively frictionally engaged hole cover of claim 16, wherein the cover plate skirt and the outer edge of the engagement member are substantially vertically aligned.

18. A selectively frictionally engaged hole cover comprising a cover plate, a bracket housing, and an engagement mechanism:

the cover plate having a top surface and a bottom surface opposite the top surface, the top surface being configured to support safe passage of pedestrians and vehicular traffic across the selectively frictionally engaged hole cover;

the bracket housing installed on the bottom surface of the cover plate and encasing a engagement support bracket, the backet housing being bowl-shaped with a flat bottom portion, an angular angled portion that extends at an upward and outward angle from bottom portion to form a sloped wall, and a skirt portion that extends from angled portion and is substantially perpendicular to bottom portion, wherein the angled portion functions as an engagement member stop; and the engagement mechanism coupled with the cover plate and extending from the bottom surface of the cover plate, the engagement mechanism comprising an engagement screw, an engagement plate, and an engagement member;

the engagement screw operably installed between the cover plate and the engagement plate thereby attaching the cover plate to the engagement mechanism, the engagement screw having a head and a shank extending from the head, the shank having a threaded portion formed thereon opposite the head; and the engagement plate having a substantially central threaded hole for selective receipt of the threaded portion of the engagement screw that enables selective shifting of the engagement plate relative to the cover plate and configured to thereby shift the engagement member up and against the engagement member stop and thus radially outwardly or down and away from the engagement member stop and thus radially inwardly;

wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.

19. A selectively frictionally engaged hole cover comprising a cover plate and an engagement mechanism:

the cover plate having a top surface and a bottom surface opposite the top surface, the top surface being configured to support safe passage of pedestrians and vehicular traffic across the selectively frictionally engaged hole cover;

the engagement mechanism coupled with the cover plate and extending from the bottom surface of the cover plate, the engagement mechanism comprising an engagement screw, an engagement plate, an engagement member, a retainer plate, and a stand-off;

the engagement screw operably installed between the cover plate and the engagement plate thereby attaching the cover plate to the engagement mechanism, the engagement screw having a head and a shank extending from the head, the shank having a threaded portion formed thereon opposite the head; and the retainer plate spaced from the cover plate, the retainer plate comprising a retainer plate skirt extending downwardly from the bottom surface of the retainer plate and an engagement member stop configured at an angle spanning between the bottom surface of the retainer plate and an outer surface of the retainer plate skirt;

the stand-off couples the retainer plate to the cover plate, the stand-off having a through-hole for receipt therethrough of the shank of the engagement screw, the shank having sufficient length to pass out of the through-hole of the stand-off; and the engagement plate having a substantially central threaded hole for selective receipt of the threaded portion of the engagement screw that enables selective shifting of the engagement plate relative to the retainer plate and configured to thereby shift the engagement member up and against the engagement member stop and thus radially outwardly or down and away from the engagement member stop and thus radially inwardly;

wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.

20. A selectively frictionally engaged hole cover comprising a cover plate and an engagement mechanism:

the cover plate having a top surface and a bottom surface opposite the top surface, the top surface being configured to support safe passage of pedestrians and vehicular traffic across the selectively frictionally engaged hole cover, wherein a cover plate skirt is formed extending downwardly from the bottom surface of the cover plate and the engagement member stop is configured at an angle spanning between the cover plate and the cover plate skirt; and the engagement mechanism being coupled with the cover plate and extending from the bottom surface of the cover plate, the engagement mechanism comprising an engagement screw, an engagement plate, an engagement member, and an engagement member stop;

the engagement screw operably installed between the cover plate and the engagement plate thereby attaching the cover plate to the engagement mechanism, the engagement screw having a head and a shank extending from the head, the shank having a threaded portion formed thereon opposite the head; and the engagement plate being selectively shiftable relative to the cover plate and configured to thereby shift the engagement member up and against the engagement member stop and thus radially outwardly or down and away from the engagement member stop and thus radially inwardly;

wherein the selectively frictionally engaged hole cover is configured to cover a bore hole formed through a paved surface with engagement mechanism positioned within the bore hole and supported at least initially therein by the cover plate that rests upon the paved surface and substantially covers the bore hole.

* * * * *